US012173993B2

(12) United States Patent
DeCosta et al.

(10) Patent No.: US 12,173,993 B2
(45) Date of Patent: Dec. 24, 2024

(54) DEAD STOP ASSEMBLY

(71) Applicant: Action Target Inc., Provo, UT (US)

(72) Inventors: Robert DeCosta, Spanish Fork, UT (US); James Harmon, Idaho Falls, ID (US)

(73) Assignee: Action Target Inc., Provo, UT (US)

( * ) Notice: Subject to any disclaimer, the term of this patent is extended or adjusted under 35 U.S.C. 154(b) by 1313 days.

(21) Appl. No.: 16/723,731

(22) Filed: Dec. 20, 2019

(65) Prior Publication Data

US 2020/0208947 A1 Jul. 2, 2020

Related U.S. Application Data

(60) Provisional application No. 62/784,678, filed on Dec. 24, 2018.

(51) Int. Cl.
*F41J 9/02* (2006.01)
*F41J 13/00* (2009.01)

(52) U.S. Cl.
CPC . *F41J 9/02* (2013.01); *F41J 13/00* (2013.01)

(58) Field of Classification Search
CPC ..... F41J 9/02; F41J 13/00; F41J 9/00; F41J 7/00; F41J 7/02
USPC ..... 104/257, 259, 239, 255, 254, 251, 249; 273/406, 370, 369, 368, 367, 366, 408, 273/403, 360, 359
See application file for complete search history.

(56) References Cited

U.S. PATENT DOCUMENTS 157,335 A 12/1874 Lyon
293,846 A * 2/1884 Bonzano ..... B61K 7/20 104/259
429,942 A 6/1890 McBride
483,060 A 9/1892 Holm
570,820 A 11/1896 Scratton
631,175 A 8/1899 Parnall
840,610 A 1/1907 Easdale
879,670 A 2/1908 Petry
937,733 A 10/1909 Worrell
947,068 A * 1/1910 Weiske ..... B61K 7/20 104/257
950,101 A 2/1910 Green
960,085 A 5/1910 Giles
960,892 A 6/1910 Gates
(Continued)

FOREIGN PATENT DOCUMENTS

CA 2100631 2/1994
GB 2136932 9/1984
(Continued)

OTHER PUBLICATIONS

Caswell International Corp., Product Literature, Copyright 2002.
(Continued)

*Primary Examiner* — Jeffrey S Vanderveen
(74) *Attorney, Agent, or Firm* — BATEMAN IP; Randall B. Bateman

(57) ABSTRACT

A dead stop assembly includes a deceleration member which is attachable at one end to a rail such that when a target retriever applies force to the deceleration member, the target retriever is decelerated. The deceleration member may be disposed in a housing which further engages the rail when the housing is impacted by a target retriever.

22 Claims, 21 Drawing Sheets

(56) References Cited

U.S. PATENT DOCUMENTS 998,638 A * 7/1911 Rink ..... B61K 7/20 104/257
1,025,944 A 5/1912 Elliott
1,036,879 A 8/1912 Miner
1,207,456 A 12/1916 Whelan
1,348,283 A 8/1920 Koehl
1,424,632 A 8/1922 Fenton
1,517,461 A 8/1924 Robinson
1,540,802 A 6/1925 Ordway
1,543,605 A 6/1925 Gavard
1,559,171 A 10/1925 Knowles
1,657,931 A 7/1926 Krantz
1,640,954 A 8/1927 Mach
1,738,874 A 12/1929 Domingo
1,831,289 A 11/1931 Dally
2,048,155 A 1/1935 Armantrout
2,008,359 A 7/1935 Lamb
2,039,552 A 5/1936 Reynolds
2,085,933 A 7/1937 Vaughan
2,104,171 A 1/1938 Schwerin
2,179,471 A 11/1939 Lee
2,284,510 A 5/1942 Cates
2,290,297 A 7/1942 Smith
2,344,829 A 3/1944 McAvoy
2,372,111 A 3/1945 Norberg
2,547,478 A 7/1948 Lieberman
2,538,118 A 6/1949 Miller
2,483,690 A 10/1949 Carlson
2,494,210 A 1/1950 Robinson
2,535,280 A 12/1950 Gartrell
2,586,958 A 2/1952 Keller
2,587,042 A 2/1952 Haiselup
2,613,934 A 10/1952 Tabler
2,706,634 A 4/1955 Van Valkenburg
2,809,836 A 10/1957 Clair
2,838,309 A 6/1958 Merz et al.
2,819,903 A 8/1958 Saunders
2,905,469 A 9/1959 Taylor
2,957,694 A 10/1960 Barber
2,967,712 A 1/1961 Breitenfeldt
3,014,725 A 12/1961 Lewis
3,032,808 A 5/1962 Fleming
3,064,976 A 11/1962 Kuhn
3,087,701 A 4/1963 Wallace
3,103,362 A 9/1963 Elofson
3,113,773 A 12/1963 Ripepe
3,140,874 A 7/1964 Jensen et al.
3,233,904 A 2/1966 Gillam et al.
3,348,843 A 10/1967 Stanley
3,363,900 A 1/1968 Cadle
3,385,405 A 5/1968 Cullen
3,392,980 A 7/1968 Ortega
3,422,538 A 1/1969 Panissidi
3,443,505 A 5/1969 Kaufman
3,471,153 A 10/1969 Baumler
3,510,133 A 5/1970 Gretzky
3,515,388 A 6/1970 Zachmeier
3,540,729 A 11/1970 Rahberger
3,601,353 A 8/1971 Dale
3,614,102 A 10/1971 Nikoden, Sr.
3,638,894 A 2/1972 Leutenegger
3,720,411 A 3/1973 Vogelaere
3,755,942 A 9/1973 Samsing
3,802,098 A 4/1974 Sampson et al.
3,914,879 A 10/1975 Taylor, III
3,992,007 A 11/1976 Seeman
4,072,313 A 2/1978 Murso et al.
4,076,247 A 2/1978 Kim et al.
4,084,299 A 4/1978 Noda
4,086,711 A 5/1978 Gammarino et al.
4,177,835 A 12/1979 Paley
4,205,847 A 6/1980 Steiger et al.
4,228,569 A 10/1980 Snyder
4,232,867 A 11/1980 Tate, Sr.
4,249,743 A 2/1981 Lee
4,288,080 A 9/1981 Laporte et al.
4,294,452 A 10/1981 Schlotter et al.
4,340,370 A 7/1982 Marshall et al.
4,361,330 A 11/1982 Scharer
4,395,045 A 7/1983 Baer
4,440,399 A 4/1984 Smith
4,480,723 A * 11/1984 Ingvast ..... B61K 7/08 188/62
4,501,427 A 2/1985 Payne
4,506,416 A 3/1985 Ohminato et al.
4,524,976 A 6/1985 Seitz et al.
4,540,182 A 9/1985 Clement
4,546,984 A 10/1985 Towle et al.
4,614,345 A 9/1986 Doughty
4,657,261 A 4/1987 Saunders
4,691,925 A 9/1987 Scholem
4,706,963 A 11/1987 Geuss
4,726,593 A 2/1988 Wade
4,739,996 A 4/1988 Vedder
4,743,032 A 5/1988 Summers et al.
4,786,059 A 11/1988 Barini
4,807,888 A 2/1989 Pidde
4,844,476 A 7/1989 Becker
4,890,847 A 1/1990 Cartee et al.
4,898,391 A 2/1990 Kelly et al.
4,911,453 A 3/1990 Essex et al.
4,913,389 A 4/1990 McCracken
4,953,875 A 9/1990 Sudit
4,979,752 A 12/1990 Fosseen
5,054,723 A 10/1991 Arnold
5,145,133 A 9/1992 France
5,163,689 A 11/1992 Bateman
5,213,336 A 5/1993 Bateman
5,232,227 A 8/1993 Bateman
5,240,258 A 8/1993 Bateman
5,242,172 A 9/1993 Bateman
5,257,790 A 11/1993 Meadows
5,263,721 A 11/1993 Lowrance
5,277,432 A 1/1994 Bateman
5,316,479 A 5/1994 Wong et al.
5,324,043 A 6/1994 Estrella
5,346,226 A 9/1994 Block
5,350,180 A 9/1994 Acock
5,352,170 A 10/1994 Condo et al.
5,361,455 A 11/1994 Kiefer
5,400,692 A 3/1995 Bateman
5,433,451 A 7/1995 De Vries
5,535,662 A 7/1996 Bateman
5,598,996 A 2/1997 Rath
5,605,335 A 2/1997 Simpson
5,618,044 A 4/1997 Bateman
5,621,950 A 4/1997 White
5,636,995 A 6/1997 Sharpe, III et al.
5,641,288 A 6/1997 Zaenglein, Jr.
5,648,794 A 7/1997 Jelsma et al.
5,649,706 A 7/1997 Treat, Jr. et al.
5,676,378 A 10/1997 West
5,695,196 A 12/1997 Yanosky
5,765,832 A 6/1998 Huff
5,802,460 A 9/1998 Parvulescu et al.
5,811,718 A 9/1998 Bateman
5,822,936 A 10/1998 Bateman
5,829,753 A 11/1998 Wiser
5,865,439 A 2/1999 Marcuson
5,906,552 A 5/1999 Padilla
5,907,930 A 6/1999 Ricco
5,934,678 A 8/1999 Theissen et al.
5,947,477 A 9/1999 Turnipseed
5,950,283 A 9/1999 Sato
5,951,016 A 9/1999 Bateman
5,963,624 A 10/1999 Pope
5,967,522 A 10/1999 Corcoran et al.
5,967,523 A 10/1999 Brownlee
5,988,645 A 11/1999 Downing
6,018,847 A 2/2000 Lu
6,109,614 A 8/2000 Ciarcia
6,223,029 B1 4/2001 Stenman et al.
6,230,214 B1 5/2001 Liukkonen et al.
6,283,756 B1 9/2001 Danckwerth et al.

(56) References Cited

U.S. PATENT DOCUMENTS 6,289,213 B1 9/2001 Flint et al.
6,308,062 B1 10/2001 Chien et al.
6,311,980 B1 11/2001 Sovine et al.
6,322,444 B1 11/2001 Matsui et al.
6,325,376 B1 12/2001 Elliott et al.
6,328,651 B1 12/2001 Lebensfeld et al.
6,332,243 B1 12/2001 Kim
6,378,870 B1 4/2002 Sovine
6,398,215 B1 6/2002 Carroll
6,463,299 B1 10/2002 Macor
6,478,301 B1 11/2002 Witmeyer
6,484,990 B1 11/2002 Marshall
6,502,820 B2 1/2003 Slifko
6,533,280 B1 3/2003 Sovine et al.
6,543,778 B2 4/2003 Baker
6,561,103 B2 * 5/2003 Peck ..... B23Q 7/1468 105/29.1
6,575,753 B2 6/2003 Rosa et al.
6,588,759 B1 7/2003 Bateman
6,679,795 B2 1/2004 Ouimette et al.
6,718,596 B2 4/2004 Kohlstrand et al.
6,728,546 B1 4/2004 Peterson et al.
RE38,540 E 6/2004 Bateman
6,761,357 B2 6/2004 Witt
6,776,418 B1 8/2004 Sovine et al.
6,808,177 B2 10/2004 Dehart
6,808,178 B1 10/2004 Sovine
6,896,267 B1 5/2005 Le Anna
6,975,859 B1 12/2005 Lambert et al.
6,994,347 B2 2/2006 Tessel et al.
6,994,348 B2 2/2006 Lambert et al.
6,994,349 B2 2/2006 Lambert et al.
7,114,725 B2 10/2006 Camp
7,128,321 B1 10/2006 Brown
7,134,977 B2 11/2006 Campbell et al.
7,140,615 B1 11/2006 Sovine et al.
7,175,181 B1 2/2007 Bateman et al.
7,194,944 B2 3/2007 Lambert et al.
7,201,376 B2 4/2007 Kuosa
7,219,897 B2 5/2007 Sovine et al.
7,234,890 B1 6/2007 Marshall et al.
7,264,246 B2 9/2007 Sovine et al.
7,275,748 B2 10/2007 Lambert et al.
7,302,768 B2 12/2007 Gajdacs
7,303,192 B2 12/2007 Marshall et al.
7,306,230 B2 12/2007 Lambert et al.
7,322,771 B1 1/2008 Marshall et al.
7,427,069 B2 9/2008 Bateman et al.
7,431,302 B2 10/2008 Bassett et al.
7,448,967 B1 11/2008 Panneri
7,469,903 B2 12/2008 Marshall et al.
7,497,441 B2 3/2009 Marshall et al.
7,503,250 B2 3/2009 Lambert et al.
7,556,268 B2 7/2009 Bateman et al.
7,653,979 B2 2/2010 Bateman et al.
7,775,526 B1 8/2010 Lambert et al.
7,793,937 B2 9/2010 Bateman et al.
7,815,192 B1 10/2010 Kreiman et al.
7,823,466 B2 11/2010 Glass
7,914,004 B2 3/2011 Wright et al.
7,950,666 B2 5/2011 Stincelli et al.
8,006,981 B2 8/2011 Gibson
8,016,291 B2 9/2011 Wright et al.
8,091,896 B2 1/2012 Lambert et al.
8,128,094 B2 3/2012 Lambert et al.
8,162,319 B2 4/2012 Stincelli et al.
8,276,916 B2 10/2012 Bateman et al.
8,469,364 B2 6/2013 Bassett et al.
8,485,529 B2 7/2013 Bateman et al.
8,550,465 B2 10/2013 Wright et al.
8,579,294 B2 11/2013 Wright et al.
8,684,361 B2 4/2014 Henson et al.
8,713,829 B1 5/2014 Crofford
8,806,952 B1 8/2014 Glass
8,813,401 B2 8/2014 Diercks
8,827,273 B2 9/2014 John et al.
9,157,706 B2 10/2015 Shea
9,217,623 B2 12/2015 Sovine et al.
9,228,810 B2 1/2016 Bateman et al.
9,482,498 B1 11/2016 Miller
9,513,091 B2 12/2016 Roberts
9,574,855 B2 2/2017 Davis
9,784,538 B2 10/2017 Sovine et al.
9,897,420 B2 2/2018 Horch
9,927,216 B2 3/2018 Anderson et al.
10,023,007 B2 7/2018 Horch
10,024,633 B2 7/2018 Horch
D829,231 S 9/2018 Hess et al.
10,072,911 B2 9/2018 Horch
10,088,283 B2 10/2018 Bateman et al.
10,168,128 B2 1/2019 Sovine et al.
10,240,903 B2 3/2019 Coe et al.
10,295,314 B2 5/2019 Anderson
10,371,489 B2 8/2019 Wall et al.
10,488,140 B2 11/2019 Scott et al.
10,488,161 B2 11/2019 Anderson et al.
10,539,402 B2 1/2020 Anderson et al.
D875,752 S 2/2020 Nelson et al.
D879,908 S 3/2020 Nelson et al.
10,619,980 B2 4/2020 Stolvorthy et al.
D885,513 S 5/2020 Nelson et al.
D886,846 S 6/2020 Nelson et al.
10,876,821 B2 12/2020 Green et al.
2005/0001381 A1 1/2005 Lambert et al.
2005/0022658 A1 2/2005 Bateman
2005/0034594 A1 2/2005 Parks et al.
2006/0107985 A1 5/2006 Sovine
2006/0234069 A1 10/2006 Sovine et al.
2006/0240388 A1 10/2006 Marshall et al.
2006/0240391 A1 10/2006 Sovine et al.
2006/0290063 A1 12/2006 Hagar
2006/0290064 A1 12/2006 Hagar
2007/0072537 A1 3/2007 Bateman et al.
2007/0102883 A1 5/2007 Parks et al.
2007/0234800 A1 10/2007 Stout et al.
2008/0047365 A1 2/2008 Hsieh
2008/0185786 A1 8/2008 Loveland et al.
2008/0277876 A1 11/2008 Riley
2009/0014961 A1 1/2009 Bateman et al.
2009/0206551 A1 8/2009 Parks et al.
2010/0311015 A1 12/2010 Sovine et al.
2011/0024985 A1 2/2011 Potterfield
2011/0062668 A1 3/2011 Leimberer
2011/0233869 A1 9/2011 John et al.
2012/0187631 A1 7/2012 John et al.
2012/0193872 A1 8/2012 Henson et al.
2012/0247314 A1 10/2012 Bassett et al.
2012/0261882 A1 * 10/2012 Wright ..... B61K 7/20 273/359
2012/0274028 A1 11/2012 Sudbeck et al.
2013/0106059 A1 5/2013 Larue
2013/0207347 A1 8/2013 Sovine et al.
2014/0138916 A1 5/2014 Wright et al.
2014/0159311 A1 6/2014 Bateman et al.
2014/0203510 A1 7/2014 John et al.
2014/0232068 A1 8/2014 Henson et al.
2014/0284881 A1 9/2014 Sovine et al.
2014/0346734 A1 11/2014 John et al.
2015/0260486 A1 9/2015 Trimbath
2015/0276356 A1 10/2015 Cesternino
2015/0292842 A1 10/2015 Pixton
2015/0330747 A1 11/2015 Ferrell
2015/0330748 A1 11/2015 Anzalone
2016/0195371 A1 7/2016 Bateman et al.
2016/0209057 A1 7/2016 Stolworthy et al.
2016/0209182 A1 7/2016 Soviine et al.
2016/0209184 A1 7/2016 Anderson et al.
2017/0190212 A1 7/2017 Horch
2017/0205206 A1 7/2017 Horch
2017/0205207 A1 7/2017 Anderson
2017/0205209 A1 7/2017 Coe et al.
2017/0205210 A1 7/2017 Wall et al.
2017/0205211 A1 7/2017 Horch
2017/0328688 A1 11/2017 Bateman et al.

(56) References Cited

U.S. PATENT DOCUMENTS

| | | | |
|---|---|---|---|
| 2017/0350677 | A1 | 12/2017 | Sovine et al. |
| 2018/0149452 | A1 | 5/2018 | Horch |
| 2018/0172409 | A1 | 6/2018 | Anderson et al. |
| 2018/0180372 | A1 | 6/2018 | Scott et al. |
| 2018/0180373 | A1 | 6/2018 | Scott et al. |
| 2018/0202777 | A1 | 7/2018 | Green et al. |
| 2018/0209767 | A1 | 7/2018 | Anderson et al. |
| 2018/0299232 | A1 | 10/2018 | Thompson |
| 2019/0145172 | A1 | 5/2019 | Parker |
| 2019/0212107 | A1 | 7/2019 | Sharp et al. |
| 2019/0219369 | A1 | 7/2019 | Harmon et al. |
| 2019/0219370 | A1 | 7/2019 | Anderson et al. |
| 2020/0208947 | A1 | 7/2020 | DeCosta et al. |

FOREIGN PATENT DOCUMENTS

| | | | |
|---|---|---|---|
| GB | 2 187 270 | | 9/1987 |
| GB | 2533147 | A | 6/2016 |
| WO | WO 2010/119440 | A1 | 10/2010 |

OTHER PUBLICATIONS

Duelatron, Product Literature 1995.
Law Enforcement Targets, Inc., Product Literature, Jul. 8, 2003.
Law Enforcement Targets, Inc., Product Literature, Oct. 12, 2004.
Law Enforcement Targets, Inc., Product Literature, Jun. 26, 2007.
Metal Spinning Target, Inc., Dueling Trees, Jul. 8, 2003.
Mike Gibson Manufacturing, Dueling Tree, Jul. 8, 2003.
Outwest Mfg. Products, Product Literature, Jul. 8, 2003.
Porta Target, Product Literature, Circa 2000.
Shootrite, Tactical Training Target, published prior to Apr. 4, 2005.
Guns & Ammo, Oct. 1984, "Seligman Dueling Tree".
Purported United States Marine Corps Dueling Tree engineering drawings allegedly dated Jun. 12, 2000.
Purported United States Marine Corps Dueling Tree engineering drawings allegedly dated Nov. 10, 1997.
2000 ESPN Great Outdoors Games Dueling Tree purportedly used in Jul. 2000.

* cited by examiner

DEAD STOP ASSEMBLY

BACKGROUND

State of the Art

The present invention relates to a method for decelerating a target retriever. In particular, the present invention relates to a dead stop assembly which provides improved stopping of a target retriever.

FIELD OF ART

In order to properly train law enforcement officers and the military, it is important to train under live fire scenarios which help condition the trainee to respond appropriately to a given set of circumstances. In many cases this involves the trainee shooting at targets on a shooting range. For example, a target may be advanced a certain distance, e.g. 25 feet, and then turned to expose the target. In one scenario the target may include a photograph of an armed person pointing a gun at the officer, soldier, etc. In another scenario the target may be a photograph of a person holding out a cell phone or other device which does not pose a threat to the trainee. In still other scenarios a photograph may be placed on the target in which an armed person is holding a weapon and standing behind a hostage. By repeating such scenarios the trainee is taught to make split-second decisions regarding the need to fire or not. As the officer, soldier, etc. becomes more comfortable with his or her ability to rapidly assess and respond to different scenarios, the risk of fatality to the trainee and innocent bystanders is reduced.

In order to facilitate such training, many shooting ranges will have targets mounted on target retrievers. The target retrievers typically move along a rail. In some situations the retriever simply advances to a desired position, stops, and turns the target so as to expose the trainee to the desired scenario. In other situations, the target retriever may be moved at a high rate of speed. For example, a target may be turned at 25 feet from the trainee and then rapidly advanced toward the trainee to simulate an officer being attacked by a criminal. The officer may need to shoot three rounds within a desired area prior to the target being stopped.

Likewise, the target retriever may be alternately advanced towards and moved away from the trainee to simulate other scenarios. When done at a high rate of speed, the target retriever may have substantial inertia and may be difficult to stop. If the braking mechanism on the retriever is inadequate or fails, there is a need for a dead stop to prevent the target retriever from running off the rail and potentially injuring people. Because of the mass of a target retriever, they have been known to shear the bolts of a dead stop and create a potentially dangerous situation for the trainee or others in the area. Thus, it is desirable to provide a dead stop assembly which is robust and brings the target retriever to a more gradual stop.

SUMMARY OF THE INVENTION

The following summary of the present invention is not intended to describe each illustrated embodiment or every possible implementation of the invention, but rather to give illustrative examples of application of principles of the invention.

In some configurations, the invention may comprise a dead stop assembly for decelerating a target retriever. The dead stop assembly may include a housing and a deceleration member for decelerating a target retriever.

In accordance with one aspect of the invention, the housing may include one or more projections for insertion into one or more slots disposed along a rail used to carry the target retriever.

In accordance with another aspect of the invention, the deceleration member may be attached at one end to the rail and attached in the opposing end to the housing.

In accordance with another aspect of the invention, the deceleration member may be a piston and cylinder which has a first extended position and a second, compressed position.

In accordance with another aspect of the invention, the deceleration member may be a spring which has a first, extended position and a second, compressed position.

In accordance with another aspect of the invention, the deceleration member may be rubber or foam which has a first, extended ambient condition and a second, compressed position.

In accordance with another aspect of the invention, the deceleration member may be formed from rubber or other elastic material which has a first, ambient position and a second, extended position for decelerating the retriever.

In accordance with another aspect of the invention, a position indicator may be disposed on the housing so as to provide a viewer with the ability to determine when the housing has been displaced due to impact with a target retriever.

It will be appreciated that aforementioned aspects of the invention are unique and that the invention can be implemented without all aspects set forth above. Therefore, no claim contained herein should be read as including any particular aspect without language setting forth such an element.

BRIEF DESCRIPTION OF THE DRAWINGS

Various embodiments of the present disclosure are shown and described in reference to the numbered drawings wherein.

Figure 1:
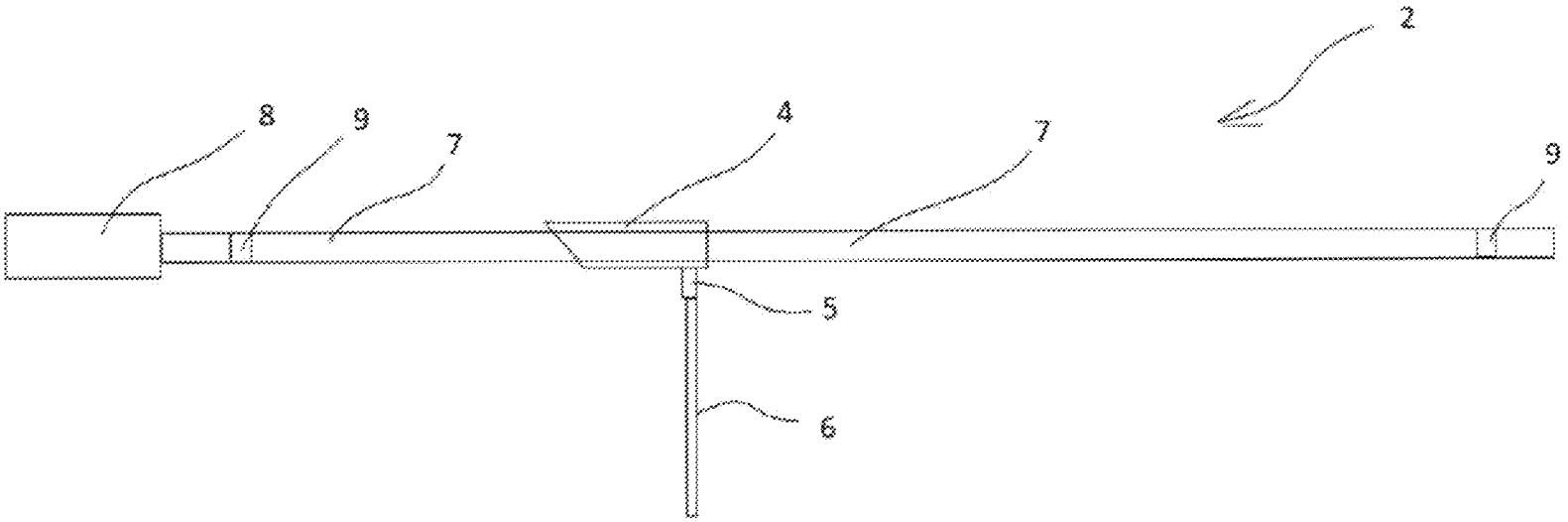
FIG. 1 (Prior Art)
FIG. 1 shows a target retriever system in accordance with the prior art.

It will be appreciated that the drawings are illustrative and not limiting of the scope of the invention which is defined by the appended claims. The embodiments shown accomplish various aspects and objects of the invention. It will be appreciated that it is not possible to clearly show each element and aspect of the present disclosure in a single figure, and as such, multiple figures are presented to separately illustrate the various details of different aspects of the invention in greater clarity. Similarly, not all configurations or embodiments described herein or covered by the appended claims will include all of the aspects of the present disclosure as discussed above.

DETAILED DESCRIPTION

Various aspects of the invention and accompanying drawings will now be discussed in reference to the numerals provided therein so as to enable one skilled in the art to practice the present invention. The skilled artisan will understand, however, that the methods described below can be practiced without employing these specific details, or that they can be used for purposes other than those described herein. Indeed, they can be modified and can be used in conjunction with products and techniques known to those of skill in the art in light of the present disclosure. The drawings and the descriptions thereof are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

Reference in the specification to "one embodiment," "one configuration," "an embodiment," or "a configuration" means that a particular feature, structure, or characteristic described in connection with the embodiment may be included in at least one embodiment, etc. The appearances of the phrase "in one embodiment" in various places may not necessarily limit the inclusion of a particular element of the invention to a single embodiment, rather the element may be included in other or all embodiments discussed herein.

Furthermore, the described features, structures, or characteristics of embodiments of the present disclosure may be combined in any suitable manner in one or more embodiments. In the following description, numerous specific details may be provided, such as examples of products or manufacturing techniques that may be used, to provide a thorough understanding of embodiments of the invention. One skilled in the relevant art will recognize, however, that embodiments discussed in the disclosure may be practiced without one or more of the specific details, or with other methods, components, materials, and so forth. In other instances, well-known structures, materials, or operations may not be shown or described in detail to avoid obscuring aspects of the invention.

Before the present invention is disclosed and described in detail, it should be understood that the present invention is not limited to any particular structures, process steps, or materials discussed or disclosed herein, but is extended to include equivalents thereof as would be recognized by those of ordinarily skill in the relevant art. More specifically, the invention is defined by the terms set forth in the claims. It should also be understood that terminology contained herein is used for the purpose of describing particular aspects of the invention only and is not intended to limit the invention to the aspects or embodiments shown unless expressly indicated as such. Likewise, the discussion of any particular aspect of the invention is not to be understood as a requirement that such aspect is required to be present apart from an express inclusion of that aspect in the claims.

It should also be noted that, as used in this specification and the appended claims, singular forms such as "a," "an," and "the" may include the plural unless the context clearly dictates otherwise. Thus, for example, reference to "a bracket" may include an embodiment having one or more of such brackets, and reference to "the target plate" may include reference to one or more of such target plates.

As used herein, the term "substantially" refers to the complete or nearly complete extent or degree of an action, characteristic, property, state, structure, item, or result to function as indicated. For example, an object that is "substantially" enclosed would mean that the object is either completely enclosed or nearly completely enclosed. The exact allowable degree of deviation from absolute completeness may in some cases depend on the specific context, such that enclosing the nearly all of the length of a lumen would be substantially enclosed, even if the distal end of the structure enclosing the lumen had a slit or channel formed along a portion thereof. The use of "substantially" is equally applicable when used in a negative connotation to refer to the complete or near complete lack of an action, characteristic, property, state, structure, item, or result. For example, structure which is "substantially free of" a bottom would either completely lack a bottom or so nearly completely lack a bottom that the effect would be effectively the same as if it lacked a bottom.

As used herein, the term "generally" refers to something that has characteristics of a quality without being exactly that quality. For example, a structure said to be generally vertical would be at least as vertical as horizontal, i.e. would extend 45 degrees or greater from horizontal. Likewise, something said to be generally circular may be rounded like an oval but need not have a consistent diameter in every direction.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Concentrations, amounts, proportions and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

Turning now to FIG. 1, there is shown a target retriever system, generally indicated at 2, made in accordance with the prior art. The target retriever system 2 includes a target retriever 4 which typically includes an actuator 5 for turning a target 6. The target retriever 4 moves back and forth along the rail 7 under power of a motor unit 8. The target retriever 4 may be connected to the motor unit 8 by a cable or other connector. Alternatively, the target retriever 4 may include a motor unit contained within the retriever.

One concern with target retriever 4 is that the cable may get out of alignment or the braking mechanism may fail, thereby resulting in a retriever which will not stop at the appropriate location. To prevent risk of injury and potential damage to the target retriever 4, dead stops 9 are placed adjacent opposing ends of the rail 7 to provide emergency stopping for the target retriever. The dead stops 9, however, can potentially damage the retriever and may be sheared off if the retriever is traveling at a rate of speed which is too high.

Figure 2:
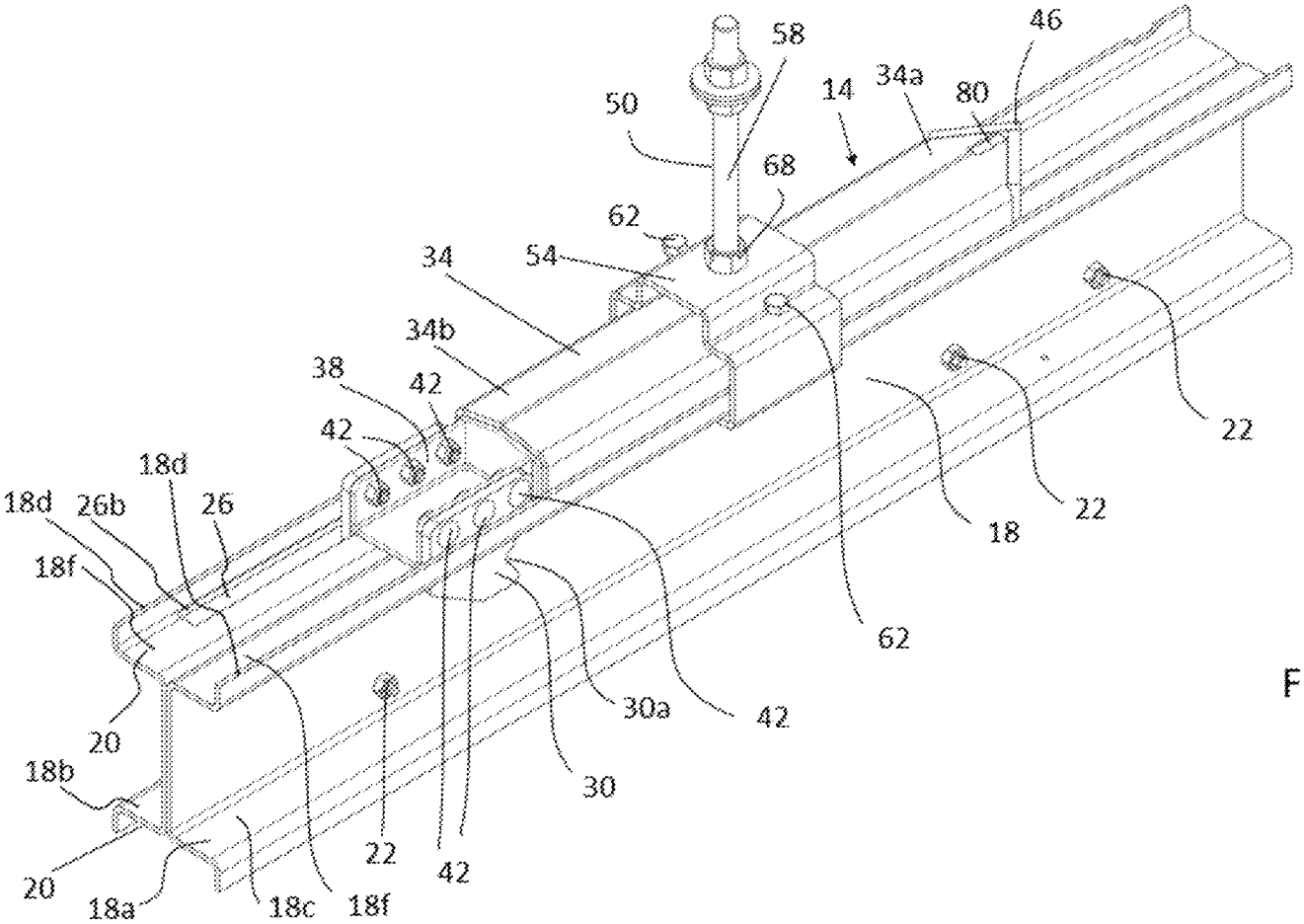
FIG. 2 illustrates a rear elevated perspective view of a dead stop assembly disposed on a rail in accordance with one aspect of the present invention.

Turning now to FIG. 2, there is shown an elevated perspective view of a dead stop assembly, generally indicated at 14, disposed on a rail 18. The rail 18 can be formed from a variety of materials and may have a variety of configurations. For example, rail 18 includes a first generally C-shaped member 18*a* and a second generally C-shaped member 18*b* placed back to back so as to form a structure similar to an I-beam with a channel 20 on the top and bottom. The generally C-shaped members may be attached in a variety of ways, including welding, adhesives and/or, as shown in FIG. 1, by the use of nuts and bolts 22.

The rail 18 may include one or more slots 26 to receive one or more projections 30 from the dead stop assembly 14. The projections 30 and channels 26 can be used to help the dead stop assembly move linearly when impacted by a target retriever (not shown). Moreover, the dead stop assembly 14 can be disposed in the channel 20 on either the upper side or lower side of the rail 18. (It will be appreciated that a dead stop assembly 14 disposed on the bottom of the rail 8 would typically include a structure for holding the housing of the dead stop assembly to the rail. This could be accomplished, for example, by a plurality of tabs which extend around the lower arm or cross-member 18*c* of the rail. However, in most situations the dead stop assembly 14 will be disposed on top of the rail 18 to protect it from being hit by bullets and the like.)

The dead stop assembly 14 may include a housing 34 which may be configured to move within the channel 20 on the rail 18. The housing 34 may include a bracket 38 onto which the projections 30 may be mounted by nuts and bolts 42. This allows the projections 32 be readily replaceable. Because the projections 32 extend below the upper cross-member of the rail 18, they are subject to being hit by bullets and, therefore, can be damaged. It will be appreciated, however, that the projections could be formed integrally with the housing 34 or the bracket 38.

As shown in FIG. 2, the housing has a first end 34*a* and a second end 34*b*. The first end 34*a* may be pointed and may be covered with a guard 46 made from steel or another ballistic grade material. The guard 46 is pointed so as to deflect bullets away from the housing in the event of an errant shot, while simultaneously minimizing ricochets back towards the shooter. Thus, it will be appreciated that the dead stop assembly 14 shown in FIG. 2, may be positioned at the distal end (i.e., the end opposite the shooter) of the rail 18. A similar dead stop assembly 14 maybe also placed at the proximal end of the rail 18. In such a configuration, the pointed first end 34*a* would be pointing away from the shooter and toward the distal end.

Also shown in FIG. 2 is a hanger 50 which is used to suspend the rail 18 from the ceiling. The hanger 50 may include a gripping bracket or gripping member 54 which extends under the upper arms or cross-members 18*f* of the rail 18. A support rod or cable 58 may be attached to the gripping member 54 and extend upwardly to a ceiling or other suspension member. It will be appreciated that the gripping member 54 is preferably shaped so as to not interfere with the movement of the dead stop assembly 14.

Figure 3:
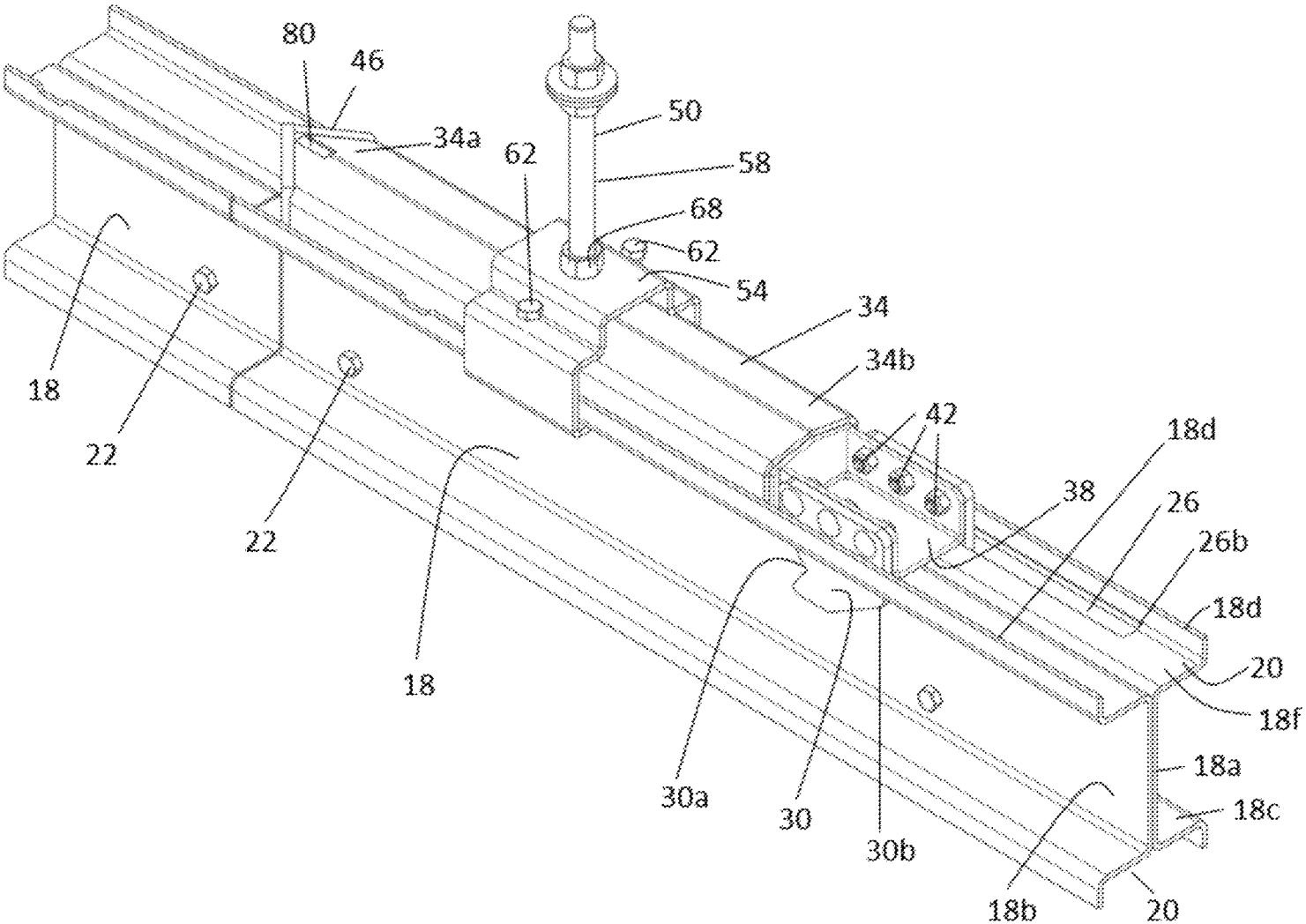
FIG. 3 illustrates an elevated perspective view of the dead stop assembly of FIG. 1 taken from the opposing side of the rail.

FIG. 3 shows the dead stop assembly 14 and rail 18 from the opposite side, so that the opposing channel and opposing projection 30 are visible. FIG. 3 is thus numbered according to the description of FIG. 2.

Figure 4:
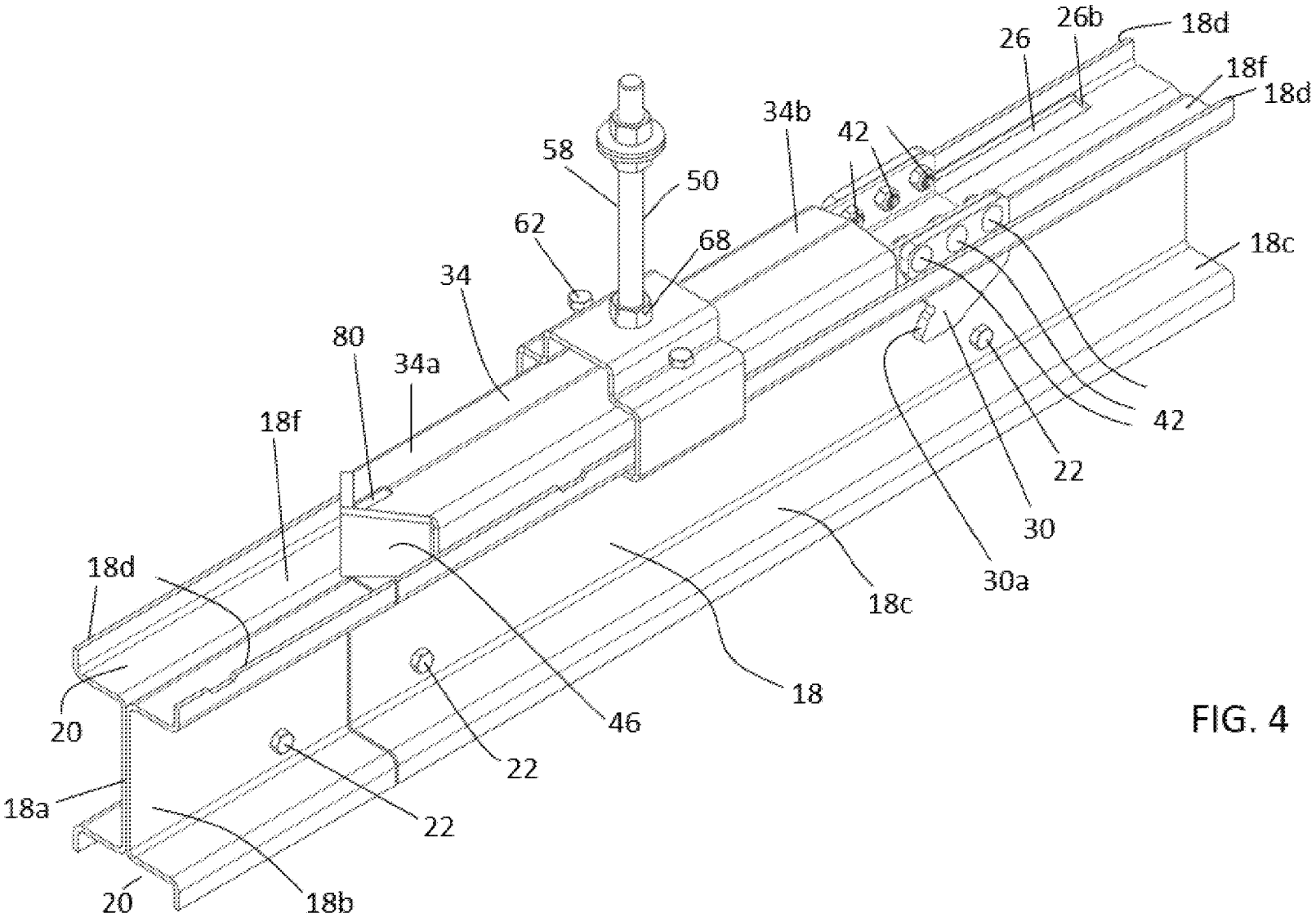
FIG. 4 illustrates a front elevated perspective view of the dead stop assembly of FIG. 1.
Figure 5:
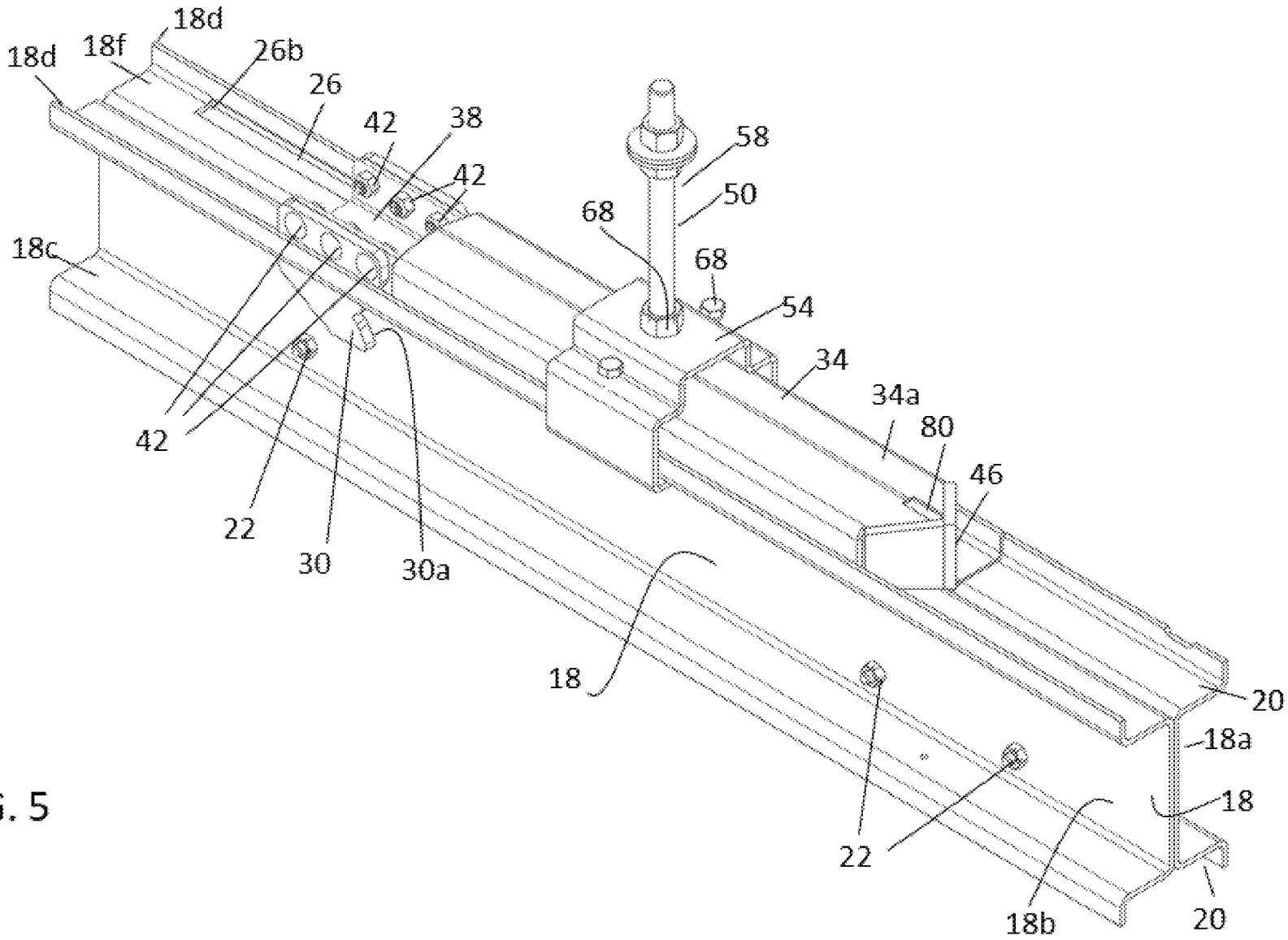
FIG. 5 illustrates a front elevated perspective view of the dead stop assembly taken from an opposing side of the rail.

FIG. 4 shows an elevated front view of the rail 18 and the dead stop assembly 14. The guard 46 at the front end 34*a* of the housing 34 is shown. If a bullet is fired toward the front end 34*a* of the housing 34, the bullet will be deflected away from the housing but still downstream so it may be collected by the bullet trap, etc., past the distal end of the rail. FIG. 5 shows a similar view from the opposing side of the rail 18, and FIGS. 4 and 5 are numbered in accordance with the description given as to FIG. 2.

Figure 6:
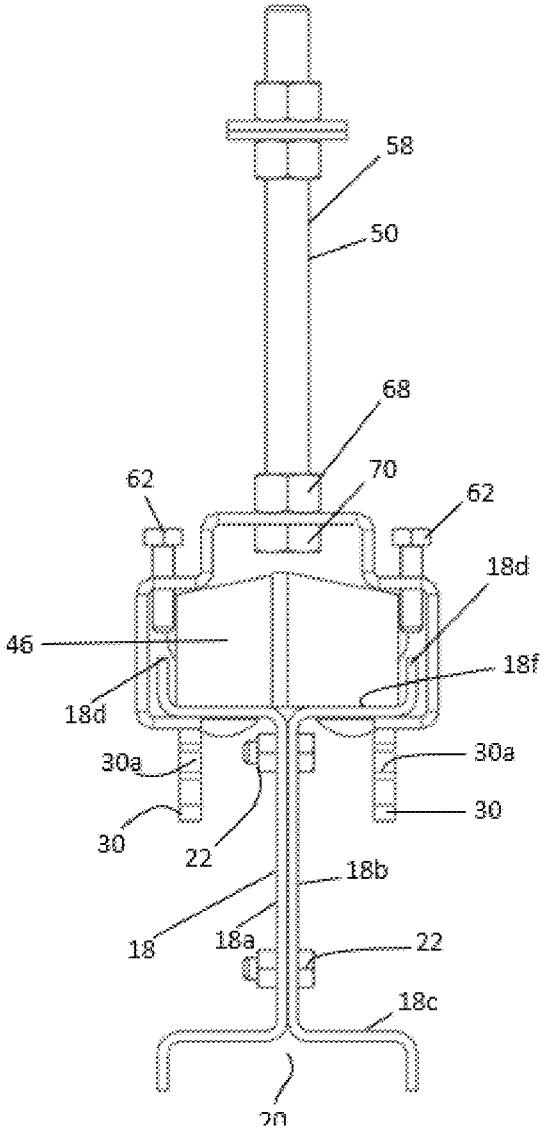
FIG. 6 shows a front end view of the dead stop assembly disposed on the rail.

Turning now to FIG. 6 there is shown a front end view of the rail 18. The housing 34 of the dead stop assembly 14 is not visible because it is concealed by the guard 46. The view also shows the gripping member 54 extending around the upper arm or cross-members 18*f* of the rail. A pair of bolts 62 may be used to engage an upper flange 18*d* of the rail 18 so that the rail is properly held in place by the gripping member 54. The bolts 62 are preferably positioned so that they do not interfere with movement of the dead stop assembly 14. The bolts and washers 66 disposed along the rod or cable 58 can be used for attachment to a support wire. Alternatively, they may be used to help hold a baffle above the rail 18 for deflecting bullets.

Also visible in FIG. 6 are the front faces 30*a* of the projections 30 which are extending downwardly through the slots (not visible in FIG. 6) in the upper cross-members 18*f* of the rail 18. The front faces 30 may be configured to engage the rail at one end of the slot so as to stop forward movement of the dead stop assembly 14 when it returns to its first, extended position.

Figure 7:
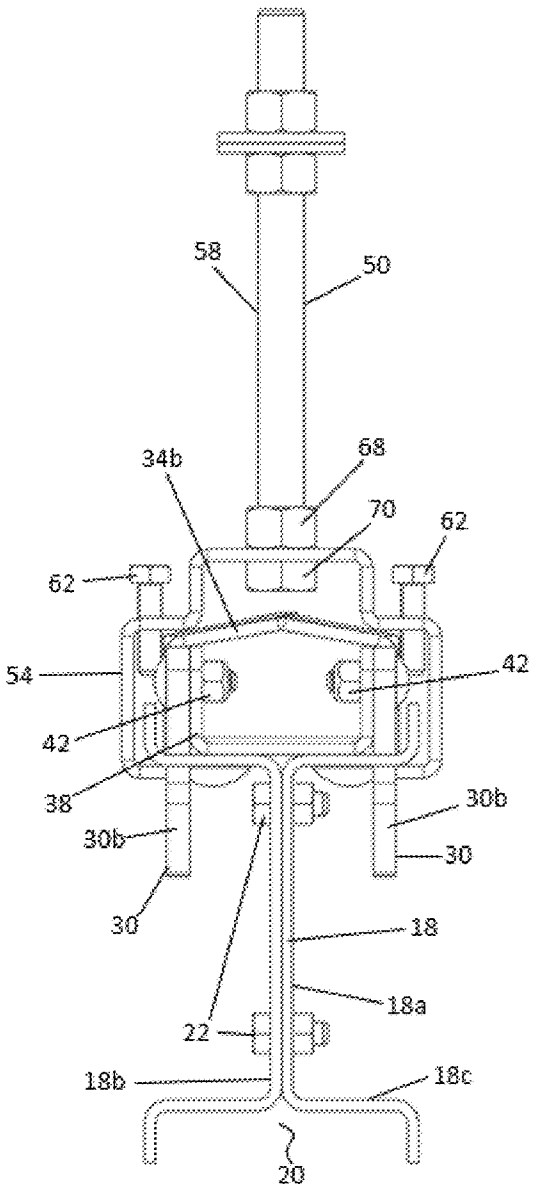
FIG. 7 shows a rear end view of the dead stop assembly disposed on the rail.

FIG. 7 shows a rear view of the housing 34, the bracket 38 and the projections 30. Also visible are the rear faces 30*b* of the projections 30 extending through the rail 18. Furthermore the gripping member 54 along with the bolt 62 and the rod or cable 58 are shown as well. FIGS. 6 and 7 also show an attachment nut 68 which secures the gripping member 54 adjacent the end 70 of the rod or cable 58 in the gripping member.

Figure 8:
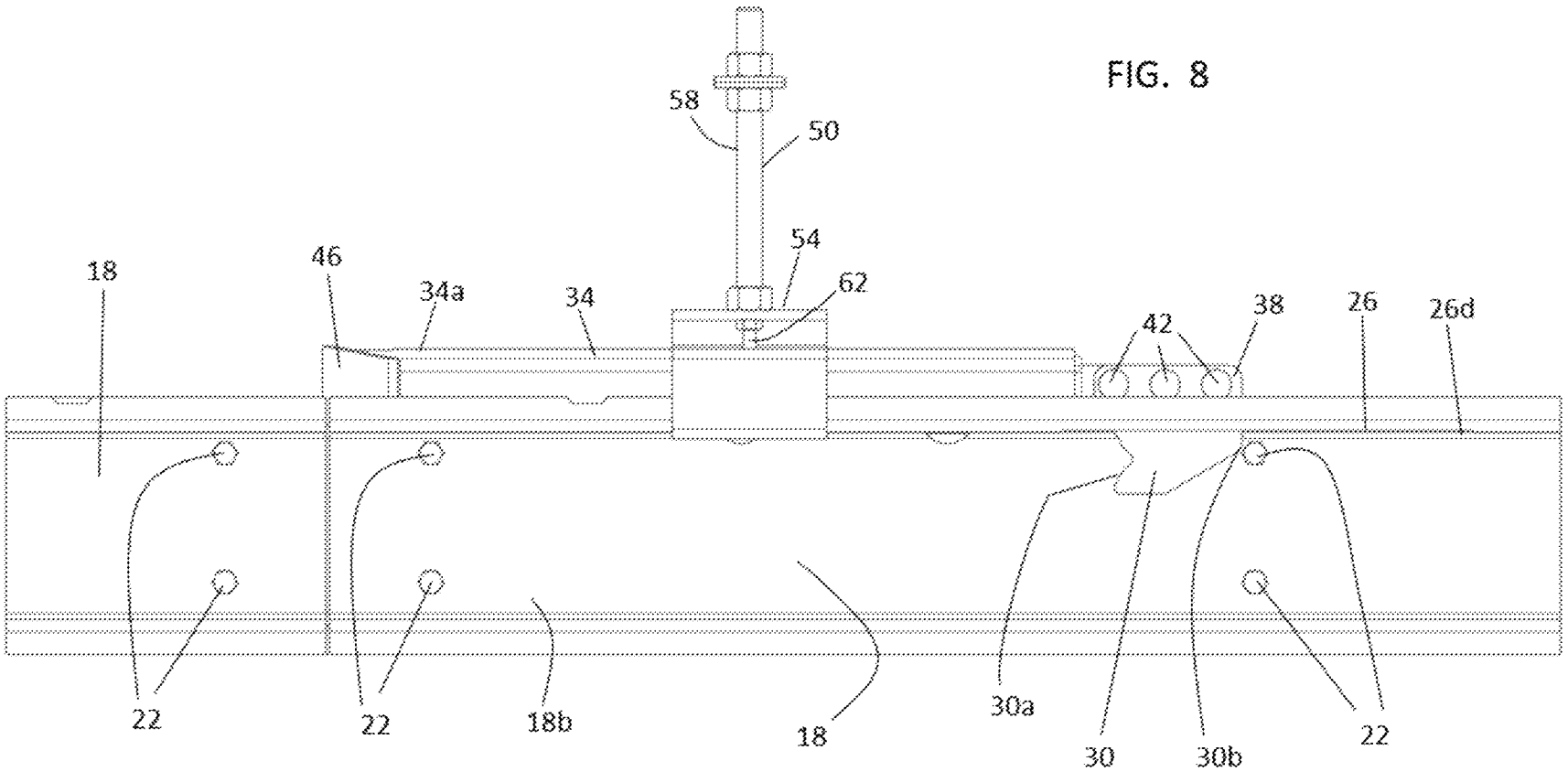
FIG. 8 shows a side view of the dead stop assembly disposed on the rail in a first, extended position.
Figure 9:
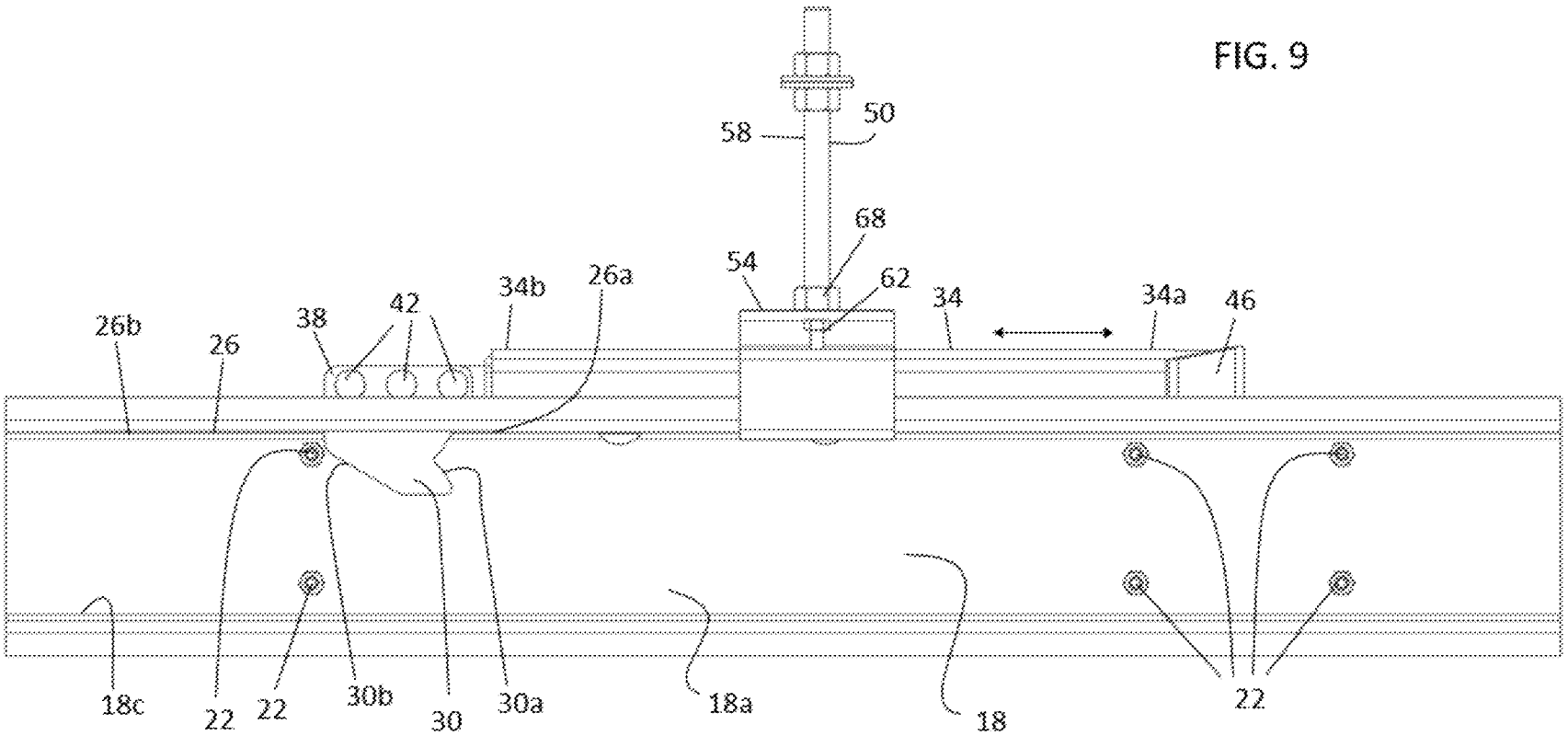
FIG. 9 shows the opposing side view of the dead stop assembly on the rail in the first, extended position.

Turning now to FIG. 8, there is shown a side view of the dead stop assembly 14 disposed on top of the rail 18 in a first, extended position. In the first extended position, the projections 30 are disposed adjacent a proximal end of the slots 26 when on a distal end of the rail 18 and adjacent a distal end of the slots when on a proximal end of the rail. Also shown in FIG. 8 is the gripping member 54, the rod or cable 58 and the bolt 62. FIG. 9 can represent either an opposing side view on the other side of the rail, or the position of the dead stop assembly at the opposing end of the rail. In FIG. 9, the dead stop assembly 14 is in a first, extended or ambient state is numbered in accordance with the previous figures.

Figure 10:
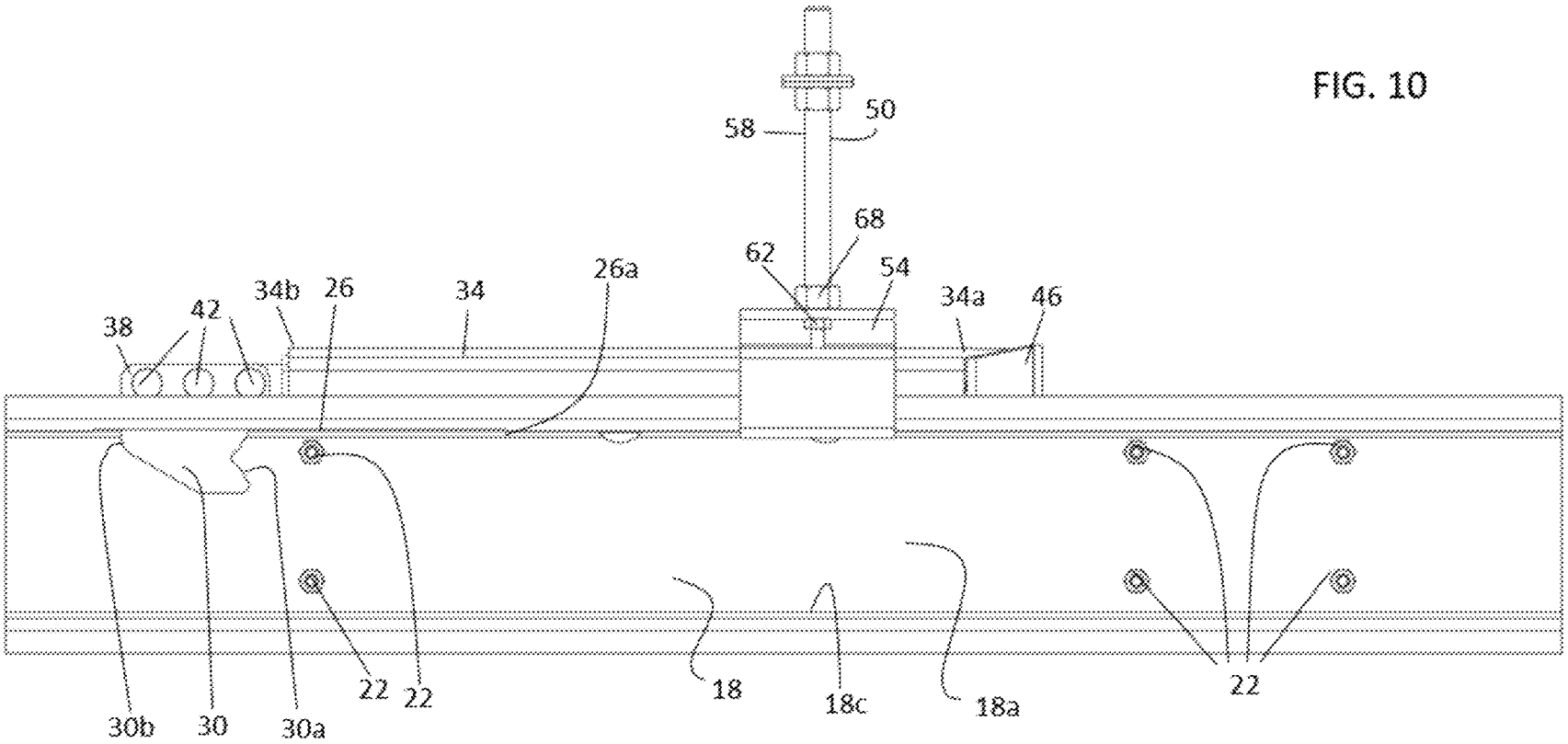
FIG. 10 shows a side view of the dead stop assembly on the rail in a second, retracted position.

FIG. 10 shows a view similar to that shown in FIG. 9, except that the dead stop assembly 14 has been pushed from the first, extended position into a second retracted position. This is shown by the position of the projections 30 within the slot 26. The front face 30*a* of the projection 30 has been moved rearwardly away from the end 26*a* of the slot 26. If the view shown in FIG. 10 was of the distal end of the rail 18, end 26*a* of the slot 14 would be the proximal (i.e. shooter) end of the slot, such that the dead stop assembly 14 has been pushed distally so that the projections 30 are closer to the distal ends 26*b* of the slots. Alternatively, if the image shown were of the proximal end of the rail 18, the end 26*a* of the slot 26 would be the distal end, with the dead stop assembly having been pushed by impact from the target retriever represented by dashed lines 72. In such a position the rear face 30*b* of the projections 30 are disposed adjacent the opposing end 26*b* of the slot 26.

Figure 11:
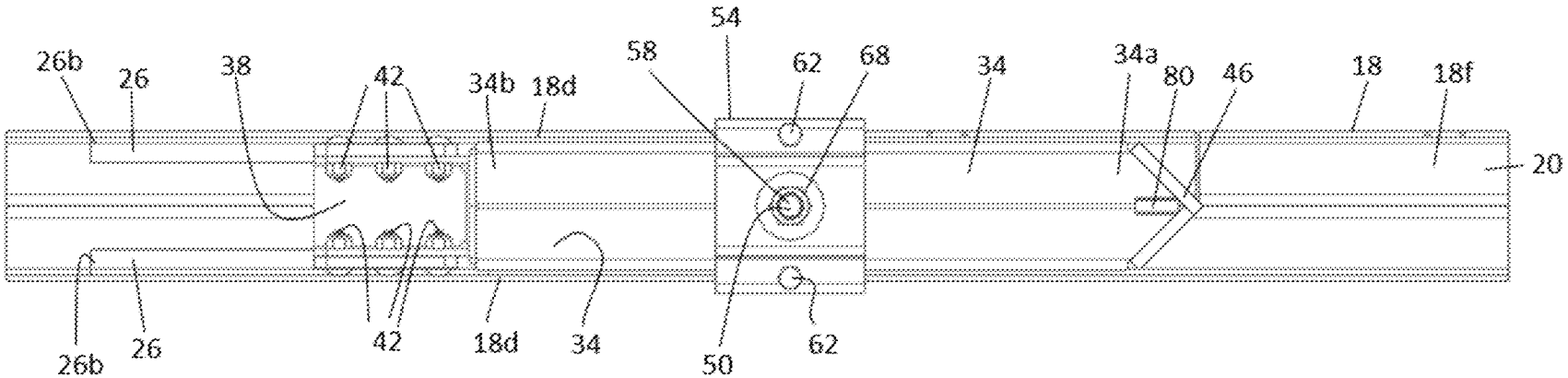
FIG. 11 shows a top view of the dead stop assembly on the rail in the first, extended position.

FIG. 11 shows a top view of the dead stop assembly 14 disposed on the rail 18 with the slots 26 being readily visible. Also shown in FIG. 11 is top view of the gripping member 54 which engages and holds the rail 18 in place. The other portions of the dead stop assembly 14 and the rail 18 are discussed previously and are numbered accordingly in FIG. 11.

Figure 12:
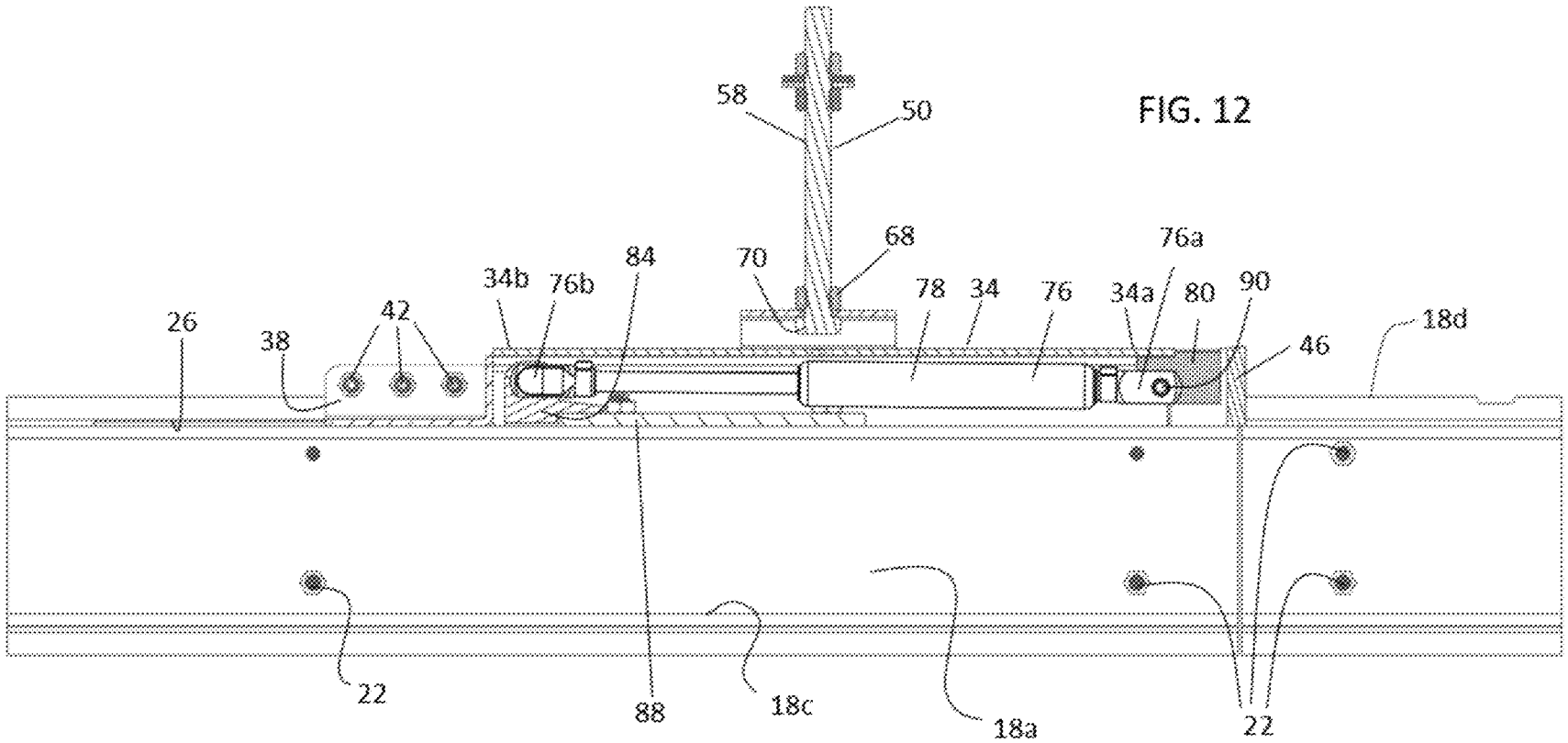
FIG. 12 shows a side cross-sectional view of the housing of the dead stop assembly disposed on the rail in the first, extended position.

Turning now to FIG. 12, there is shown a cross-sectional view of the dead stop assembly 14 when the dead stop assembly is in a first, extended position. Disposed inside the housing 34 is a deceleration or dampening member 76, which may be a spring, a shock absorber, a pneumatic spring 78 (shown in FIG. 12) or other mechanism. A first end 76*a* is attached to the housing 34 of the dead stop assembly 14 by an attachment member. This may include, for example, bolting the first end 76*a* to an attachment member, such as tab 80, which may be attached the housing 34 or to the guard 46. (It will be appreciated that the tab 80 may be welded to the housing or the guard. Additionally, it will be appreciated that the attachment may be made so as to allow the deceleration member 76 to pivot with respect to the tab.)

Figure 13:
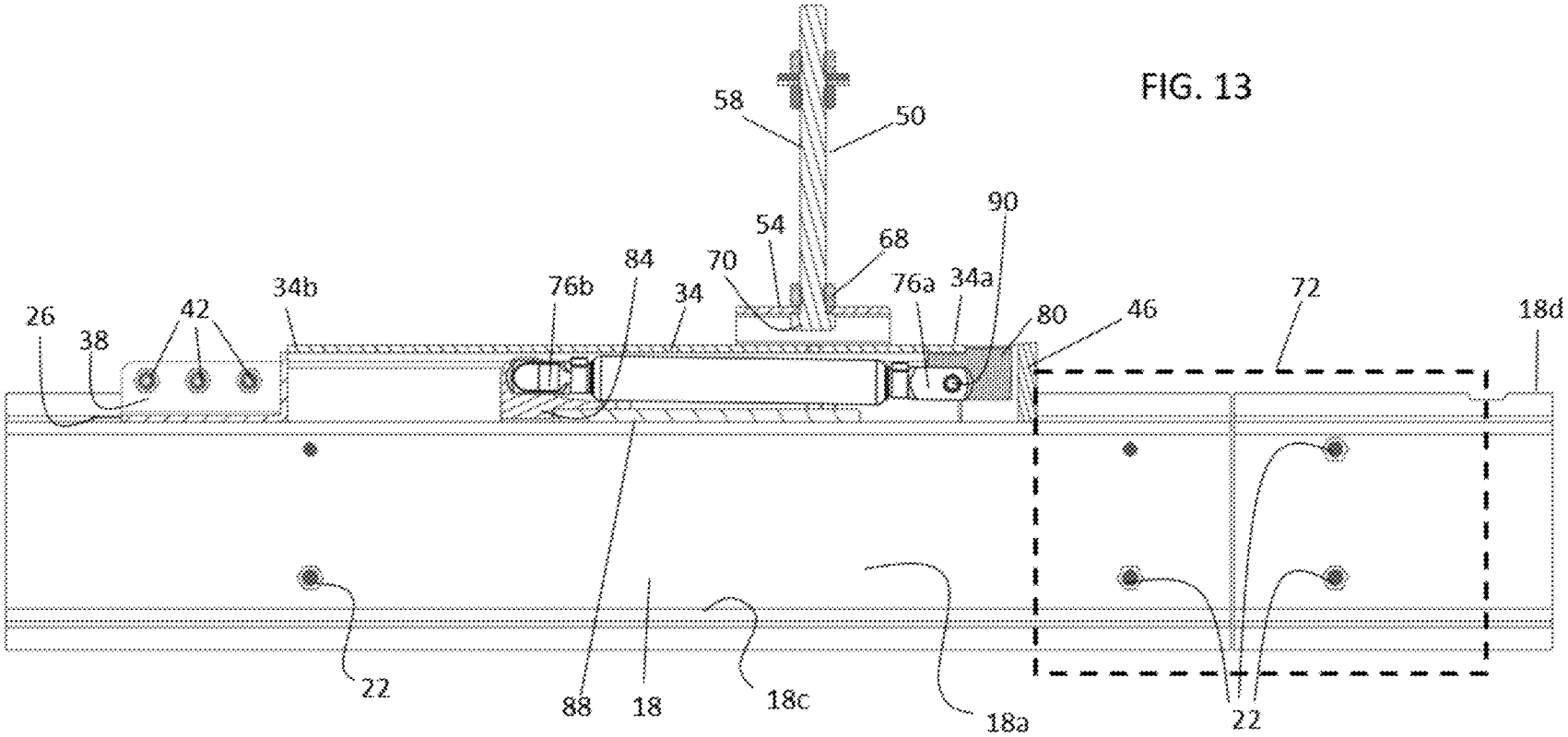
FIG. 13 shows a side cross-sectional view of the housing of the dead stop assembly disposed on the rail in the second, retracted position.

The opposing second end 76*b* may be attached to a tab 84 which is attached via a bracket 88 to the rail 18. Unlike the first end 76*a*, the second end 76*b* of the deceleration member 76 will generally not move linearly when the guard 46 is struck by a target retriever. Thus, the dampening member 76 will be moved into a second, compressed orientation such as that shown in FIG. 13. This corresponds with a movement of the housing 34 toward the end of the rail 18. As the deceleration member 76 compresses into the second position, it will decelerate the target retriever and bring it to a substantial stop. The deceleration member 76 will then move back into the first, extended orientation shown in FIG. 12 and will move the housing 34 and the target retriever back.

Because the dead stop assembly 14 decelerates the target retriever to a stop over a distance of, for example, 6 to 8 inches instead of immediately, less harm is potentially done to any sensors or other instruments carried by the target retriever. Additionally, the risk that the target retriever will simply break off the dead stop is substantially reduced as well. Therefore, the dead stop assembly 14 may provide for a longer functional life, as well as doing less damage to a target retriever that has not been properly braked.

Figure 14:
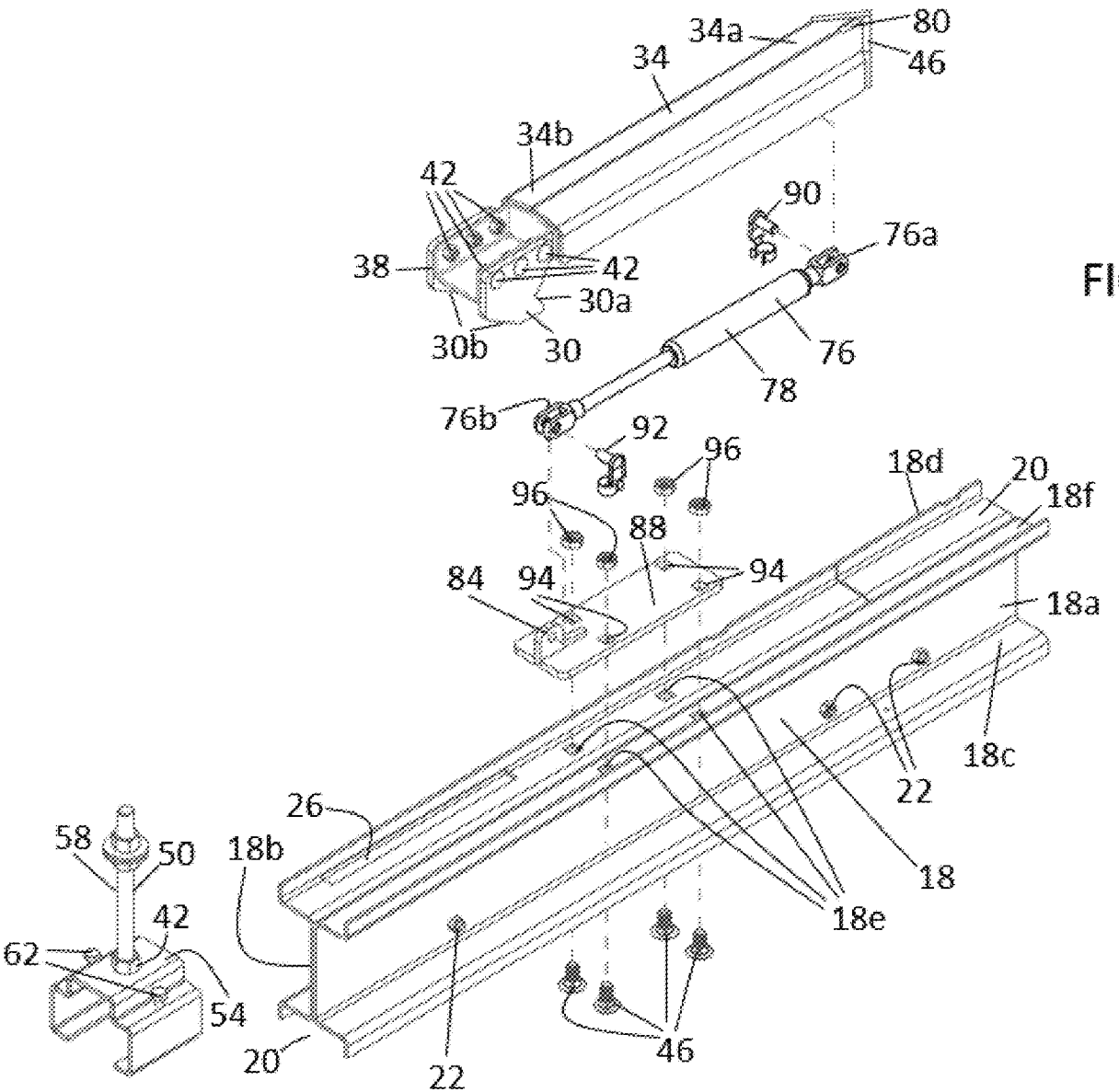
FIG. 14 shows an elevated perspective, exploded view of the dead stop assembly and rail.

Turning now to FIG. 14, there is shown an elevated, perspective exploded view of the dead stop assembly 14, the rail 18 and other parts. At the top, the housing 34 is shown with the guard 46 on one end and the bracket 38 with the projections 30 at the other end. Disposed below the housing 34 is a pin or bolt 90 which connects the end 76*a* of the deceleration member 76 to the housing 34. Also shown is a second pin or bolt 92, which can be used to attach the second end 76*b* of the deceleration member 76 to the tab 84. The pin or bolts 90, 92 may also include a retainer 98 for engaging one of the nuts to help hold the pins in place.

The tab 84 may be formed integrally with or otherwise attached to the bracket 88. The bracket 88 may include a plurality of holes 94 which may be disposed in alignment with holes 18*e* in the rail 18 so that nuts and bolts 96 can be used to anchor the bracket 88 in place on the rail. Also visible in the rail 18 are the slots 26 in which the projections 30 slide as the housing 34 moves back and forth after being impacted by a target retriever.

Figure 15:
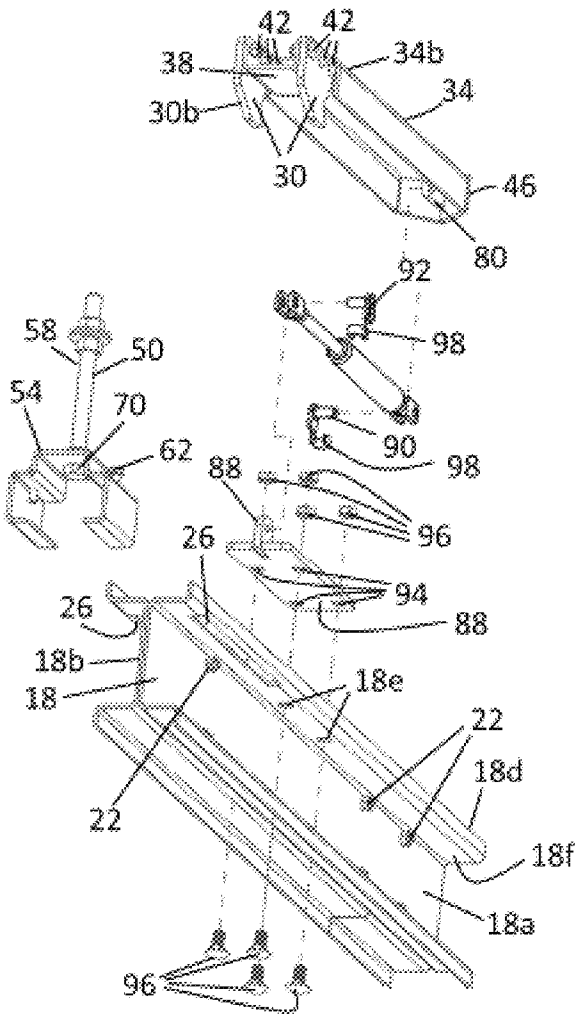
FIG. 15 shows a lower perspective, exploded view of the dead stop rail.

FIG. 15 shows a lower perspective, exploded view similar to that shown in FIG. 14 and the various components are numbered accordingly. It will be appreciated that alternative means could be used for securing the bracket 88 to the rail 18 and/or the deceleration mechanism 76 to either the tab 84 or the tab 80 of the housing. Posts, pins, bolts and other fasteners may be used.

Figure 16:
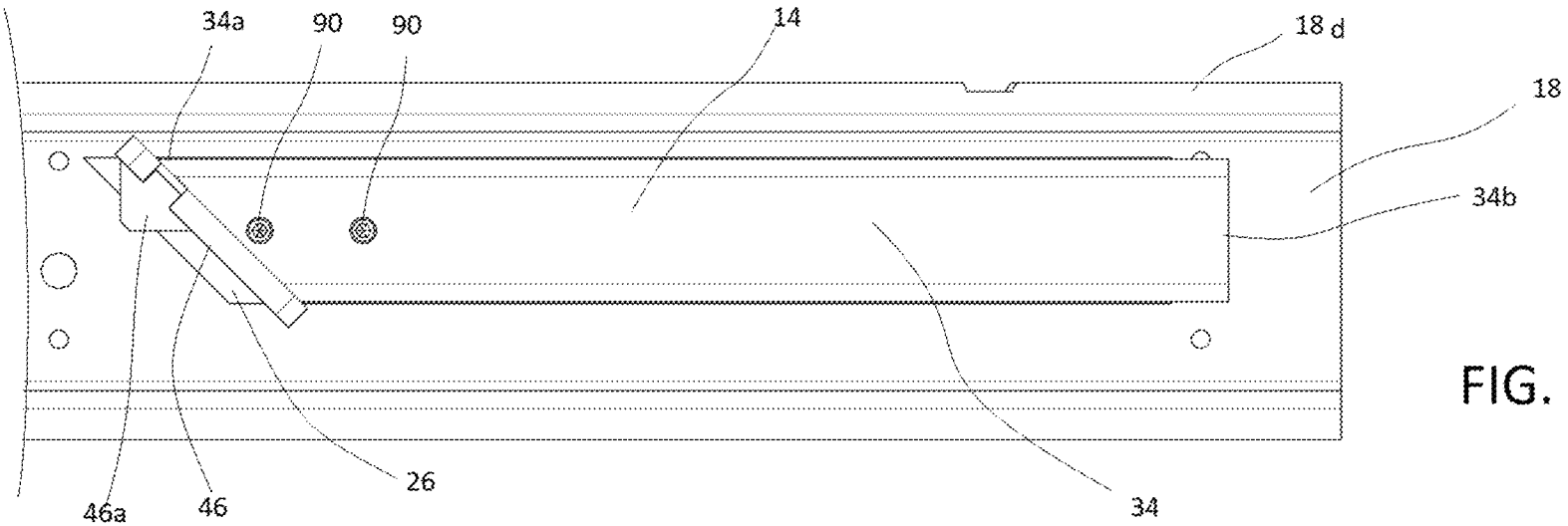
FIG. 16 shows a side view of another application of a dead stop assembly disposed in a first, extended position.

Turning now to FIG. 16, there is shown a side view of another application of a dead stop assembly 14 disposed in a first, extended position. The dead stop assembly 14 does not ride in the channel 20 (see FIG. 18) formed by the upper arms or crossmembers and flange 18*d*. Rather, the dead stop assembly 14 may be disposed on the center wall of the rail 18. The dead stop assembly 14 may include a housing 34 having a first end 34*a* and a second end 34*b*. Disposed at the first end 34*a* may be a guard 46. Rather than being beveled as the guard shown in the previous drawings, the guard 46 in FIG. 16 is sloped at a downward angle so as to deflect bullets downwardly should guard be struck. The guard 46 may also include an engagement member 46*a* which is designed to engage a target retriever 72 when the target retriever is unable to stop properly.

Figure 17:
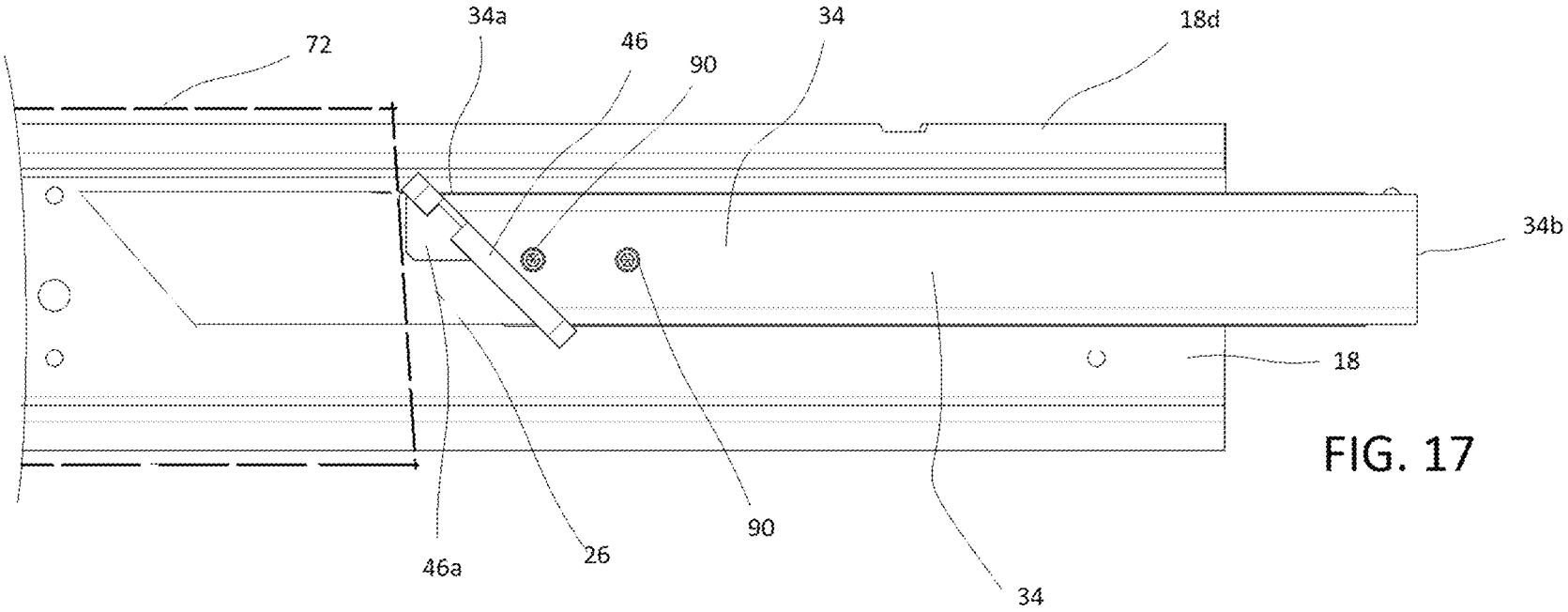
FIG. 17 shows a side view of the dead stop assembly in a second, compressed position.

As will be explained in additional detail later, the guard 46 may be attached to the housing 34 by one or more pin or bolt 90, or other fastener. The housing 34 may move along a slot or channel 26 formed in the rail 18. As shown in FIG. 16, the guard 46 is disposed at a first end of the channel 26. FIG. 17 shows the dead stop assembly 14 after the guard 46 has been impacted by a runaway target retriever represented by dashed lines 72. The entire housing 34 has been moved to the right, which would be distally if the dead stop assembly 14 were on the far end of the rail 18, or proximally if the dead stop assembly were on near a proximal end of the rail. The movement of the housing 34 reveals more of the slot or channel 26. While FIG. 17 shows the housing 34 extending beyond the end of the rail, the dead stop assembly 14 could be position so that housing member never extended beyond the end of the rail 18.

Figure 18:
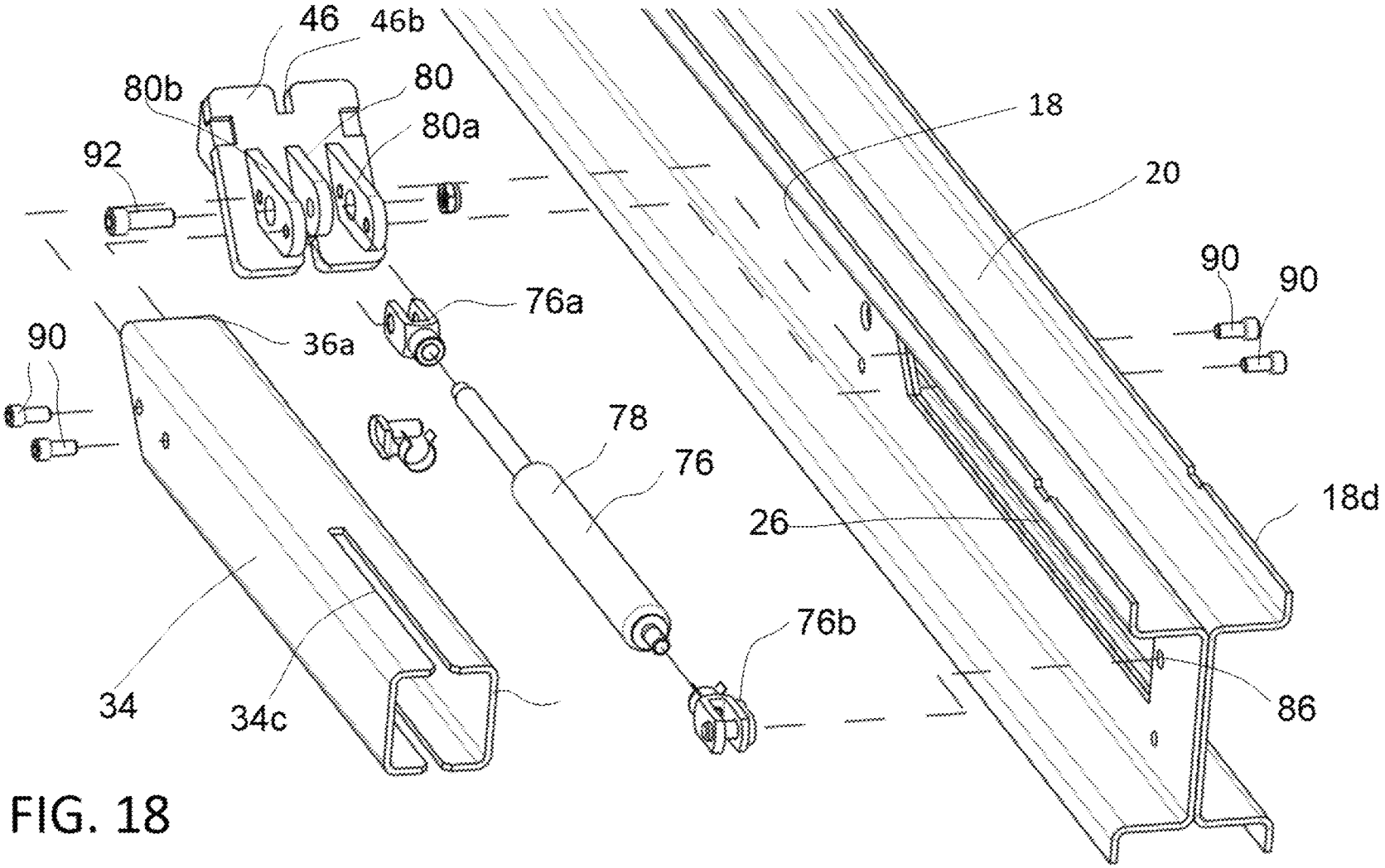
FIG. 18 shows an exploded view of the dead stop assembly of FIGS. 16 and 17.

Turning now to FIG. 18, there is shown an exploded view of the dead stop assembly 14 of FIGS. 16 and 17. The dead stop assembly 14 includes the housing 34 which may have a slot 34*c* formed therein. Normally disposed inside the housing 34 is a damping or deceleration member 76 which has a first end 76*a* which may attach to a tab 80 on the guard 46 via a pin, bolt or other fastener. The damping or deceleration member 76 may also have a second end 76*b* which attaches to rail 18 via a pin, bolt or other fastener. When the guard 46 is impacted by the target retriever 72, the damping or deceleration member 76 acts as an air spring and decelerates the target retriever of over a distance that reduces the risk of damage to the target retriever and lessens the risk of the target retriever shearing off the dead stop assembly.

Figure 19:
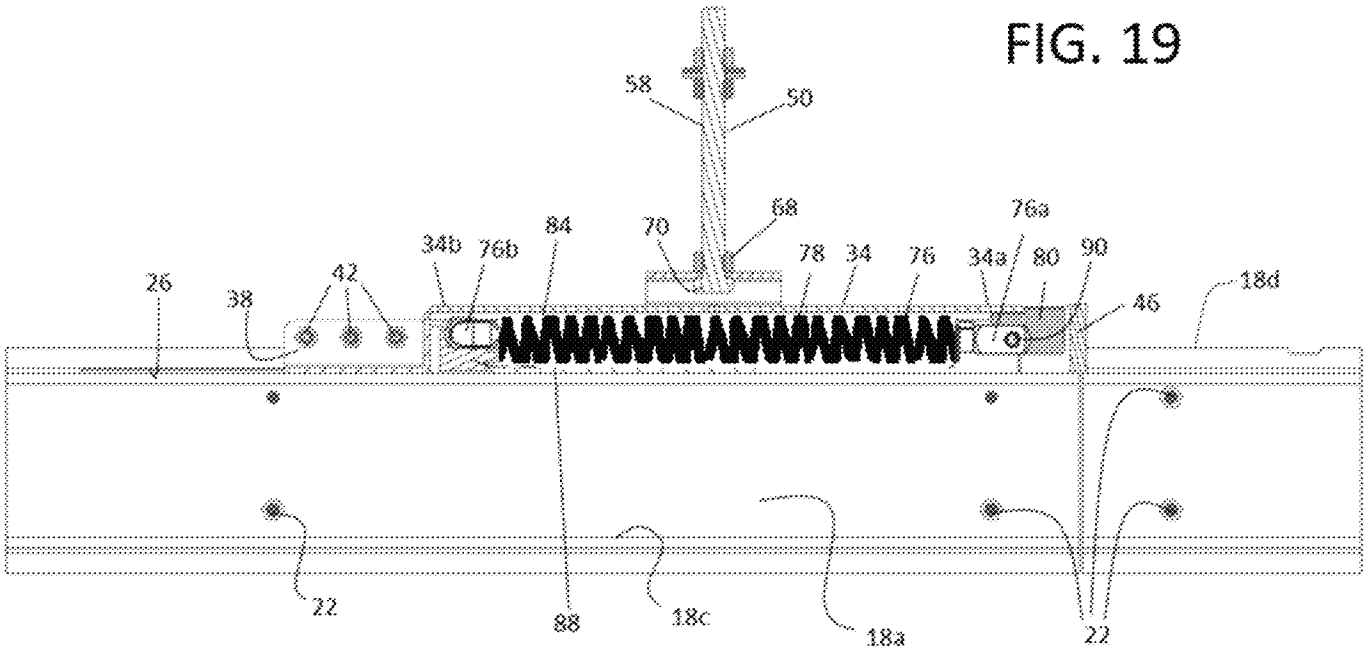
FIG. 19 shows a side cross-sectional view of a dead stop assembly using a spring.

FIG. 19 shows a side cross-sectional view of a dead stop assembly 14 wherein the damping or deceleration mechanism 76 is a spring 78. When a target retriever (not show) forcibly impacts the dead stop assembly, the spring 78 compresses as the housing 34 moves so as to more gradually slow down the target retriever. The spring 78 may have ends 76*a* and 76*b* which are attached to brackets 80 and 88 similar to the damping or deceleration mechanisms discussed above, or may simply have a spring contained within a chamber such that movement of the housing 34 is resisted by compression of the spring. The remaining structures of the dead stop assembly 14 and the rail 18, etc., may be similar to those described above and are numbered accordingly. However, it will be appreciated that the spring 78 and the dead stop assembly 14 need not be connected to the rail 18 in the same manner as discussed above.

Figure 20:
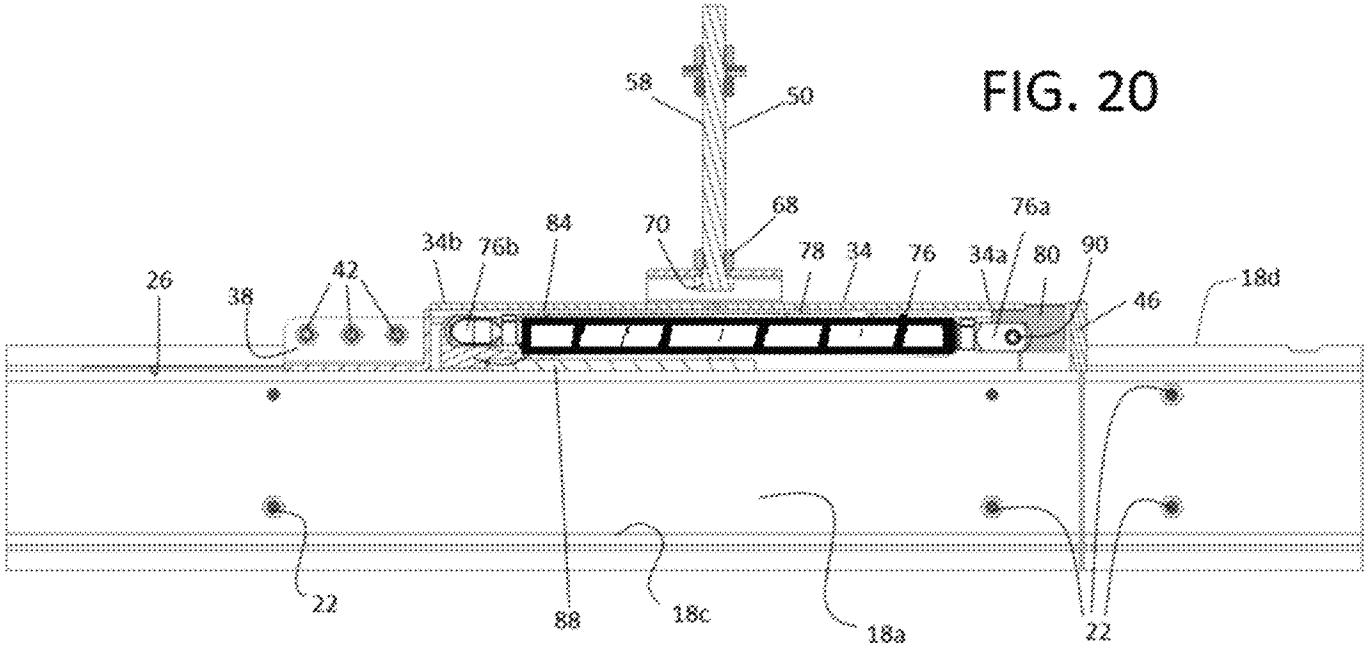
FIG. 20 shows a side cross-sectional view of a dead stop assembly using a rubber or rubber-like material between an ambient state and a compressed state.

FIG. 20 shows a side cross-sectional view of a dead stop assembly 14 using a rubber or rubber-like material, such as a resilient compressible foam or other resilient material to act as the deceleration member 76. The material may simply be held in the housing 34 in such a way that movement of the housing compresses the material. Alternatively, the material forming the deceleration member 76 may have ends 76*a* and 76*b* which attach to brackets on the housing 34 or guard 46 and to the rail 18. The dead stop 14 may convert the energy of the runaway target retriever into the force necessary to temporarily compress the material forming the deceleration member 76. Once the target retriever has been stopped, the deceleration member 76 may return to its original position and be ready for the next impart with the target retriever.

Figure 21:
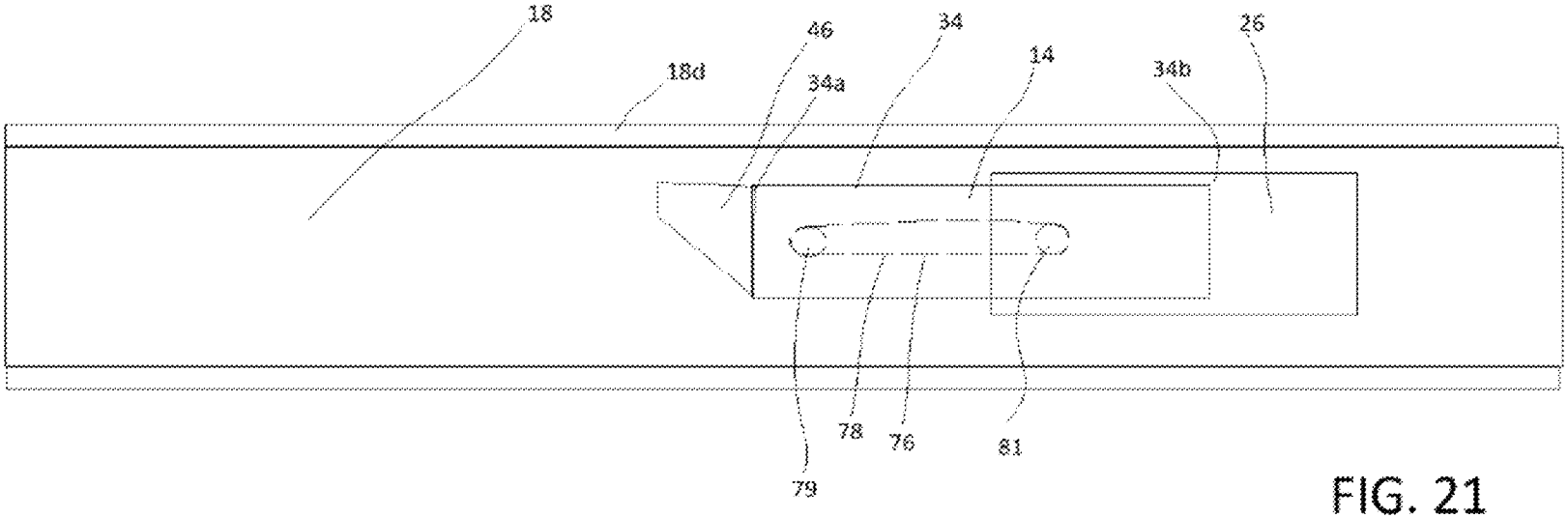
FIG. 21 shows a side cross-sectional view of a dead stop assembly using rubber or a rubber-like material between an ambient state and an extended state.

FIG. 21 shows a side view of a dead stop assembly 14 using rubber or a rubber-like material between an ambient state and an extended state. The dead stop assembly 14 may include a housing 34. A front end 34*a* of the housing 34 may be attached to a guard 46. The guard 46 may have an angled surface to help deflect any bullets which may impact the guard. The opposing end 34*b* of the housing 34 may include a bumper 36 to cushion any impact between the housing and the middle wall of the rail 18.

The housing 34 may be attached to a damping or deceleration mechanism 76 to decelerate the housing and thus a target retriever which forcefully impacts the housing. The housing 34 may be attached by a post 81 or other attachment to a resilient band or other form of spring. The opposing end of the resilient band or spring 78 may be attached by a post 79 or other attachment to the rail 18. When a target retriever impacts the guard, the housing 34 moves toward the opposing end of the channel 26 in the rail 18. As it does so, the resilient band or spring 78 stretches, buts resists movement of the housing 34, thereby decelerating the housing and the target retriever. If the resilient band or spring 78 is not sufficient to stop the housing 34 before it impacts the opposing end of the channel, the bumper 36 will help to reduce the force of the impact as it engages the rail. Thus, the target retriever will be slowed, both reducing the risk of damage to the target retriever and substantially reducing the risk that a high velocity target retriever will simply shear off the dead stop. Both help to prevent damage, reduce repair costs and promote longevity of the system.

It will be appreciated that the disclosure herein includes various parts and assemblies which can be used together. Thus, the present disclosure teaches a dead stop assembly for decelerating a target retriever moving along a rail, the dead stop assembly may include a deceleration member having a first end and a second end, and wherein the deceleration member is movable between a first, extended orientation and a second, compressed orientation and where in the first end is movable with respect to the rail and the second end is attached to the rail. Further more the dead stop assembly may include a second end of the deceleration member attached to the rail by a bracket; a second end of the deceleration member is pivotably attached to a bracket; a bracket including a tab extending upwardly away from the rail; a first end of the deceleration member being attached to the housing, or combinations thereof.

The dead stop assembly may include a deceleration member disposed inside the housing, and a tab disposed inside the housing, the first end of the deceleration member being attached to the tab; a guard disposed at one end of the housing, the guard being generally pointed and made from a ballistic material; a tab attached to the guard; at least one projection extending from the housing; a rail having at least one slot and wherein the projection extends into the slot; at least one projection attached to the housing by a bracket; and/or a projection is attached to the bracket by a plurality of removable fasteners, and combinations thereof.

The rail may include a topside and a plurality of slots and holes disposed in the topside; and the plurality of slots may extend generally lengthwise along the rail.

A dead stop assembly may include a bracket configured for attachment to a rail, a deceleration member having a first end and a second end, the second end being configured for attachment to the bracket and a housing, the housing having an attachment member for attachment to the first end of the deceleration member and at least one projection extending from the housing. The dead stop assembly may also include: at least one projection is attached to the housing by a removable fastener; first end of the deceleration member which is pivotably attached to the housing and wherein the second end of the deceleration member is pivotably attached to the bracket; a first pin and a second pin for connecting the deceleration member to the bracket and to the housing, respectively; and/or at least one projection extending from the housing having a first projection and a second projection, the first projection and the second projection being removably attached to a bracket and the bracket being attached to the housing, or combinations thereof.

The present disclosure also teaches method for decelerating a target retriever moving along a rail, having a dead stop assembly including a deceleration member movable between a first, extended orientation, and a second, compressed orientation, wherein the deceleration member has a first end and a second end and wherein the second end is attached to the rail so as to stop the second end from moving literary linearly when the deceleration member is impacted by a target retriever. The method may include attaching a housing to the first end of the deceleration member and having at least one projection attached to the housing member slide within a slot on the rail when the housing is impacted by a target retriever.

The present disclosure also teaches A dead stop assembly for stopping a target retriever moving along a rail, the dead stop assembly comprising a housing movable between a first position and a second position, the housing member having guard at one end for engaging the target retriever, a deceleration member attached to the housing and to the rail, the deceleration member disposed to slow movement of the housing from the first position to the second position, and wherein at least one of the dead stop assembly and the rail have a channel formed therein to facilitate sliding of the dead stop assembly.

Thus, there is disclosed a dead stop assembly and method of use. It will be appreciated that numerous modifications may be made without departing from the scope and spirit of this disclosure. The appended claims are intended to cover such modifications.

What is claimed is:

1. A dead stop assembly for decelerating a target retriever moving along a rail having a slot extending therethrough, the dead stop assembly comprising:

a housing; and a deceleration member having a first end and a second end, the deceleration member being movable between a first, extended orientation and a second, compressed orientation and wherein the first end is movable with respect to the rail and the second end is attached to the rail, wherein the deceleration member is attached at the first end to the housing and wherein a portion of the dead stop assembly extends through the slot extending through the rail.

2. The dead stop assembly for decelerating a target retriever moving along a rail of claim 1, wherein the second end of the deceleration member is attached to the rail by a bracket mounted on the rail and wherein the housing slides along the rail as the deceleration member is moved from the first, extended orientation to the second, compressed orientation.

3. The dead stop assembly for decelerating a target retriever moving along a rail of claim 2, wherein the second end of the deceleration member is pivotably attached to the bracket.

4. The dead stop assembly for decelerating a target retriever moving along a rail of claim 2, wherein the bracket includes a tab extending upwardly away from the rail so that the tab is disposed above the rail and the second end of the deceleration member is disposed above the rail.

5. The dead stop assembly for decelerating a target retriever moving along the rail of claim 1, wherein the housing and the deceleration member are disposed on top of the rail and wherein the housing is slidable along the top of the rail as the deceleration member returns to the first, extended orientation.

6. The dead stop assembly for decelerating a target retriever moving along the rail of claim 5, wherein the deceleration member is disposed inside the housing, and wherein a tab is disposed inside the housing, the first end of the deceleration member being attached to the tab.

7. The dead stop assembly for decelerating a target retriever moving along the rail of claim 5, further comprising a guard disposed at one end of the housing, the guard being generally pointed and made from a ballistic material.

8. The dead stop assembly for decelerating a target retriever moving along a rail of claim 7, further comprising a tab attached to the guard.

9. The dead stop assembly for decelerating a target retriever moving along a rail of claim 5, wherein the dead stop assembly includes at least one projection extending from the housing and through the slot extending through the rail.

10. The dead stop assembly for decelerating a target retriever moving along a rail of claim 9, wherein at least one projection extending from the housing is attached to the housing by a bracket.

11. The dead stop assembly for decelerating a target retriever moving along a rail of claim 10, wherein the projection is attached to the bracket by a plurality of removable fasteners.

12. The dead stop assembly for decelerating a target retriever moving along a rail of claim 1, wherein a portion of the housing extends through the slot.

13. The dead stop assembly for decelerating a target retriever moving along a rail of claim 1 wherein the rail has a topside and wherein the slot comprises a plurality of slots disposed in the topside and extending through the topside.

14. The dead stop assembly for decelerating a target retriever moving along a rail of claim 13, wherein the plurality of slots extend generally lengthwise along the rail.

15. A dead stop assembly for decelerating a target retriever along a rail having a slot extending therethrough, the dead stop assembly comprising a bracket configured for attachment to a rail, a deceleration member having a first end and a second end, the second end being configured for attachment to the bracket and a housing, the housing having an attachment member for attachment to the first end of the deceleration member and at least one projection extending from the housing and positioned extending through the slot so as to slide within the slot of the rail when the dead stop assembly is impacted by the target retriever.

16. The dead stop assembly of claim 15, wherein the at least one projection is attached to the housing by a removable fastener.

17. The dead stop assembly of claim 16, wherein the first end of the deceleration member is pivotably attached to the housing and wherein the second end of the deceleration member is pivotably attached to the bracket.

18. The dead stop assembly of claim 17 further comprising a first pin and a second pin for connecting the deceleration member to the bracket and to the housing, respectively.

19. The dead stop assembly of claim 15, wherein the at least one projection extending from the housing comprises a first projection and a second projection, the first projection and the second projection being removably attached to a bracket and the bracket being attached to the housing, the rail having a second slot such that the first projection extends through the first slot and the second projection extends through the second slot.

20. A method for decelerating a target retriever moving along a rail, the method comprising selecting a dead stop assembly including a housing, positioning a portion of the housing to extend through a slot in the rail, selecting a deceleration member having a first end and a second end, and attaching the second end to the rail so as to stop the second end from moving linearly when the deceleration member is impacted by a target retriever.

21. The method for decelerating a target retriever moving along the rail of claim 20 wherein the method further comprises attaching the housing to the first end of the deceleration member and having at least one projection attached to the housing member slide within a slot extending through the rail when the housing is impacted by a target retriever.

22. A dead stop assembly for stopping a target retriever moving along a rail, the dead stop assembly comprising a housing movable between a first position and a second position, the housing member having guard at one end for engaging the target retriever, a deceleration member attached to the housing and to the rail, the deceleration member disposed to slow movement of the housing from the first position to the second position, and wherein the rail has a channel formed therethrough to facilitate sliding of the dead stop assembly along the rail and wherein the housing extends through the channel formed through the rail.

* * * * *